US009405217B2

(12) United States Patent
Tokiwa et al.

(10) Patent No.: US 9,405,217 B2
(45) Date of Patent: Aug. 2, 2016

(54) DEVELOPER CARRYING MEMBER AND IMAGE FORMING APPARATUS

(71) Applicant: CANON KABUSHIKI KAISHA, Tokyo (JP)

(72) Inventors: Shuhei Tokiwa, Tokyo (JP); Kazunari Hagiwara, Yokohama (JP); Tatsuaki Orihara, Tokyo (JP); Makoto Fukatsu, Suntou-gun (JP); Atsushi Nakamoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/881,865

(22) Filed: Oct. 13, 2015

(65) Prior Publication Data

US 2016/0033894 A1 Feb. 4, 2016

Related U.S. Application Data

(63) Continuation of application No. PCT/JP2015/003283, filed on Jun. 30, 2015.

(30) Foreign Application Priority Data

Jun. 30, 2014 (JP) ..... 2014-134823

(51) Int. Cl.
*G03G 15/08* (2006.01)

(52) U.S. Cl.
CPC ..... *G03G 15/0808* (2013.01); *G03G 15/08* (2013.01)

(58) Field of Classification Search
CPC ..... G03G 15/0808
USPC ..... 399/286
See application file for complete search history.

(56) References Cited

U.S. PATENT DOCUMENTS 5,712,070 A 1/1998 Nozawa et al.
6,390,961 B1 * 5/2002 Nakada ..... G03G 15/0818 492/49

(Continued)

FOREIGN PATENT DOCUMENTS

JP 7-31454 B2 4/1995
JP 8-278659 A 10/1996
JP 2000-346048 A 12/2000
JP 2001-134070 A 5/2001

(Continued)

OTHER PUBLICATIONS

Zhao, et al., "Theory and Observation of Dielectric Relaxations due to the Interfacial Polarization for Terlamellar Structure", Bull. Inst. Chem. Res. Kyoto Univ., vol. 67, No. 4, 1989, pp. 225-255.

*Primary Examiner* — Susan Lee
(74) *Attorney, Agent, or Firm* — Fitzpatrick, Cella, Harper & Scinto

(57) ABSTRACT

Provided is a developer carrying member which depends on a sheet-passing speed to a small extent while maintaining satisfactory developability, and can stably suppress a fogging amount with time. The developer carrying member includes: an electro-conductive mandrel; and an electro-conductive elastic layer, in which: the elastic layer contains a resin j, an electro-semiconductive particle p, and an electro-conductive particle c; and when an electroconductivity of the resin j is defined as $\sigma_j$, a dielectric constant of the resin j is defined as $\in_j$, an electroconductivity of the electro-semiconductive particle p is defined as $\sigma_p$ and a dielectric constant of the electro-semiconductive particle p is defined as $\in_p$, $\sigma_j$, $\in_j$, $\sigma_p$, and $\in_p$ satisfy relationships represented by the following formulae (1) and (2), $\sigma_j$, $\in_j$, $\sigma_p$ and $\in_p$ being calculated by an AC impedance method.

$$\sigma_j<\sigma_p<0.05 \text{ S/cm} \quad (1)$$

$$\in_p<\in_j \quad (2)$$

5 Claims, 14 Drawing Sheets

(56) References Cited

U.S. PATENT DOCUMENTS

| | | | | |
|---|---|---|---|---|
| 7,070,552 | B2 * | 7/2006 | Mizumoto ..... | G03G 15/0808 399/279 |
| 8,007,426 | B2 | 8/2011 | Shirose et al. | |
| 2015/0132031 | A1 | 5/2015 | Hagiwara et al. | |
| 2015/0132032 | A1 | 5/2015 | Hagiwara et al. | |

FOREIGN PATENT DOCUMENTS

| | | | |
|---|---|---|---|
| JP | 2003-241505 | A | 8/2003 |
| JP | 2009-80308 | A | 4/2009 |
| JP | 2010-266512 | A | 11/2010 |
| WO | 2007/000819 | A1 | 1/2007 |

* cited by examiner

DEVELOPER CARRYING MEMBER AND IMAGE FORMING APPARATUS

CROSS-REFERENCE TO RELATED APPLICATIONS

This application is a continuation of International Application No. PCT/JP2015/003283, filed Jun. 30, 2015, which claims the benefit of Japanese Patent Application No. 2014-134823, filed Jun. 30, 2014.

BACKGROUND OF THE INVENTION

Field of the Invention

The present invention relates to a developer carrying member and an image forming apparatus using the member.

In an image forming apparatus such as a laser printer using an electrophotographic process, a contact developing system involving using a developing roller having an elastic layer has been proposed as a developing system involving using a conventional one-component toner. FIG. 2 is a schematic view for illustrating the construction of an image forming apparatus adopting the contact developing system involving using the developing roller having the elastic layer. Development is performed by causing a developing roller 14 as an elastic roller to carry a nonmagnetic developer and bringing the developing roller into contact with the surface of a photosensitive drum 1. The developer is supplied to the developing roller by a supplying roller 15 in contact with the developing roller. The supplying roller conveys the developer from the inside of a developer container 13 to adhere the developer to the developing roller. In addition, the supplying roller serves to remove the developer remaining on the developing roller once. The layer thickness regulation of the developer adhering onto the developing roller and the provision of the developer with charge by triboelectric charging are performed by bringing a toner-regulating member 16 into contact with the developing roller. It has been proposed that the following member of a blade shape be used as the toner-regulating member. The member supports a metal thin plate on one side and the ventral surface of a portion opposite to the thin plate is brought into contact with the developing roller. The developer with which the developing roller has been coated by the toner-regulating member develops an electrostatic latent image formed on the photosensitive drum with the electric potential of a bias applied onto the developing roller.

In Japanese Examined Patent No. H7-31454, there is a disclosure that fogging worsens owing to the loss of the charge of a toner particle, or the inversion of its polarity, in a region where a photosensitive member and a developing roller contact with each other.

SUMMARY OF THE INVENTION

It has been known that charge-providing performance for a toner reduces under a high-humidity environment. Particularly in a one-component contact developing system involving providing the toner with charge through triboelectric charging with a toner-regulating member, an influence of the reduction in charge-providing performance for the toner is large because the toner has an extremely small number of opportunities to obtain charge. As a result, a problem resulting from the reduction in charge-providing performance for the toner, e.g., an increase in amount of fogging occurs. The "fogging" refers to such an image failure that the toner is slightly developed in a white portion (non-printing portion) where no character is originally printed to appear like smearing, and is a problem resulting from the reduction in charge-providing performance for the toner. In addition, in a region where a photosensitive member and a developing roller contact with each other through the toner, such a voltage that a force from the photosensitive drum toward the developing roller acts on the toner provided with charge is applied in the non-printing portion. In Japanese Examined Patent No. H7-31454, it is assumed that in the voltage application region where the photosensitive member and the developing roller contact with each other, the charge of the toner escapes toward the developing roller owing to the voltage applied as described above, and hence the amount of fogging resulting from the attenuation of the toner charge increases. An increase in volume resistance value of the developing roller has been proposed as a method of suppressing the fogging amount. However, merely increasing the volume resistance value causes the deterioration of developability such as a low density.

The present invention has been made in view of the above-mentioned problems, and the present invention is directed to providing a developer carrying member and an image forming apparatus each of which depends on a sheet-passing speed to a small extent while maintaining satisfactory developability, and can stably suppress a fogging amount with time.

According to one aspect of the present invention, there is provided a developer carrying member, including: an electro-conductive mandrel; and an electro-conductive elastic layer, in which: the elastic layer contains a resin j, an electro-semiconductive particle p, and an electro-conductive particle c; and when an electroconductivity of the resin j is defined as $\sigma_j$, a dielectric constant of the resin j is defined as $\in_j$, an electroconductivity of the electro-semiconductive particle p is defined as $\sigma_p$ and a dielectric constant of the electro-semiconductive particle p is defined as $\in_p$, $\sigma_j$, $\in_j$, $\sigma_p$, and $\in_p$ satisfy relationships represented by the following formulae (1) and (2), $\sigma_j$, $\in_j$, $\sigma_p$ and $\in_p$ being calculated by an AC impedance method.

$$\sigma_j<\sigma_p<0.05\ \text{S/cm} \quad (1)$$

$$\in_p<\in_j \quad (2)$$

Further, according to another aspect of the present invention, there is provided an image forming apparatus, including: an image-bearing member configured to bear an electrostatic latent image; and a developer carrying member configured to carry a developer and to contact with the image-bearing member to develop the electrostatic latent image with the developer, in which the developer carrying member is the above-mentioned developer carrying member.

According to the aspects of the present invention, the developer carrying member and the image forming apparatus each of which depends on a sheet-passing speed to a small extent while maintaining satisfactory developability, and can stably suppress a fogging amount with time can be provided.

Further features of the present invention will become apparent from the following description of exemplary embodiments with reference to the attached drawings.

DESCRIPTION OF THE EMBODIMENTS

Now, a developer carrying member and an image forming apparatus to which the present invention is applied are described in detail.

[Image Forming Apparatus]

Figure 1:
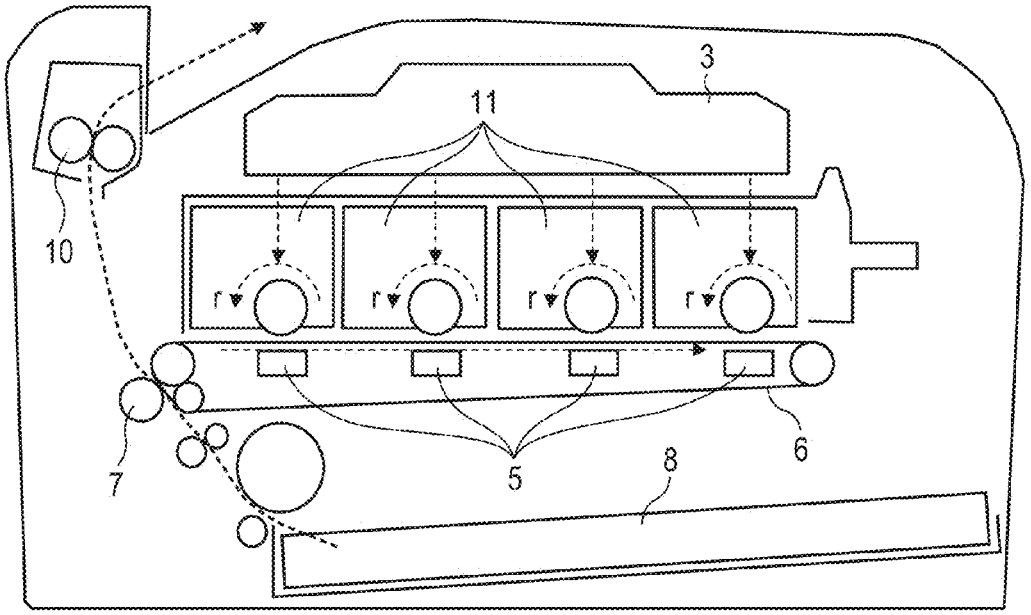
FIG. 1 is a schematic view of an image forming apparatus according to the present invention.

FIG. 1 is a schematic construction view of an image forming apparatus according to the present invention. The image forming apparatus is a full-color laser printer utilizing an electrophotographic process. Now, the entire schematic construction of the image forming apparatus according to the present invention is described by way of Embodiment 1 and Embodiment 2; provided that the dimensions, materials, and shapes of constituent parts described in embodiments to be described below, the relative arrangement of the parts, and the like are not meant to limit the scope of the present invention thereto unless otherwise stated.

Embodiment 1

Figure 2:
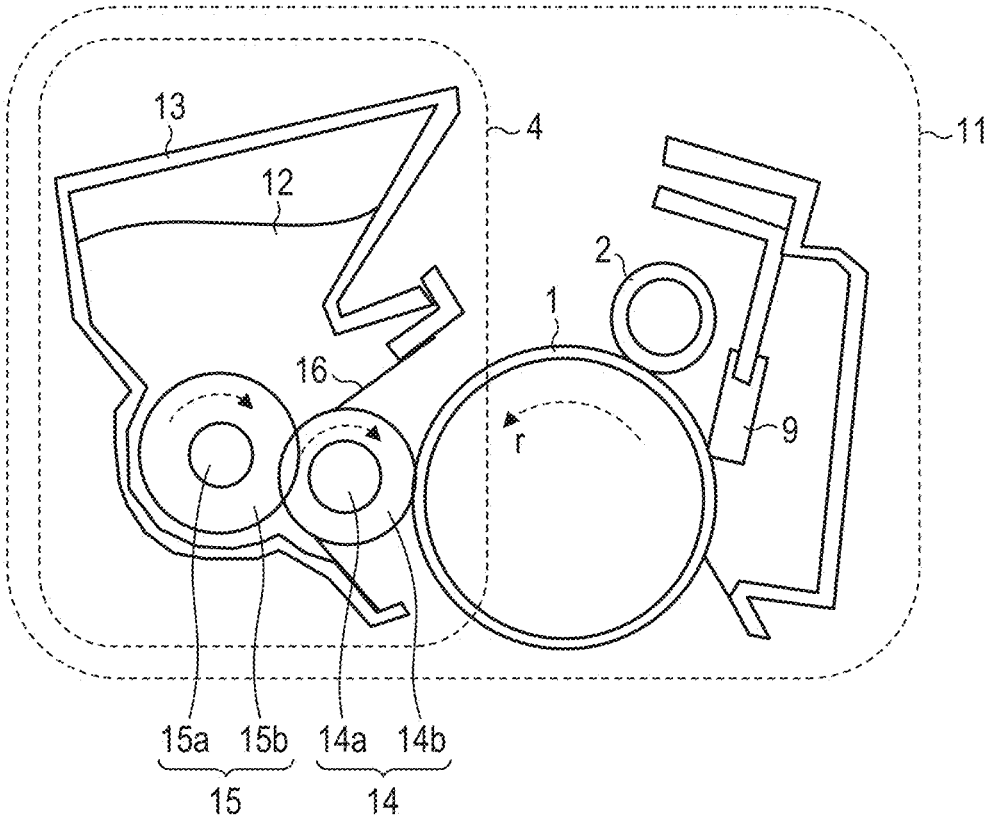
FIG. 2 is a schematic view of a process cartridge according to Embodiment 1.

An image forming apparatus applied to Embodiment 1 of the present invention is illustrated in FIG. 1. In addition, a cartridge 11 constituting the image forming apparatus is illustrated in FIG. 2. In the image forming apparatus, the photosensitive member 1 as an image-bearing member is rotated in a direction indicated by an arrow, and is charged to a uniform electric potential Vd by a charging roller 2 as a charging apparatus. Next, the photosensitive member is exposed by laser light from a laser irradiation apparatus 3 as an exposing apparatus, whereby an electrostatic latent image is formed on its surface. The electrostatic latent image is developed by a developing apparatus 4 to be visualized as a toner image. The visualized toner image on the photosensitive member is transferred onto an intermediate transfer member 6 by a primary transfer apparatus 5, and is then transferred onto paper 8 as a recording medium by a secondary transfer apparatus 7. Transfer residual toner remaining on the photosensitive member without being transferred is scraped off by a cleaning blade 9 as a cleaning apparatus. The cleaned photosensitive member repeats the above-mentioned actions to perform image formation. Meanwhile, the paper onto which the toner image has been transferred is subjected to fixation by a fixing apparatus 10, and is then discharged to the outside of the image forming apparatus.

As illustrated in FIG. 2, the photosensitive member 1, the charging roller 2, the developing apparatus 4, and the cleaning blade 9 are integrally constituted as the cartridge 11 detachably mountable to the main body of the image forming apparatus. Four portions on each of which the cartridge 11 is mounted are prepared for the main body of the image forming apparatus. In addition, cartridges filled with yellow, magenta, cyan, and black toners are mounted from the upstream side of the direction in which the intermediate transfer member 6 moves, respectively, and a color image can be formed by sequentially transferring the toners onto the intermediate transfer member.

[Image-Bearing Member]

The image-bearing member for bearing the electrostatic latent image is, for example, a photosensitive drum, and can be formed by a known process. The photosensitive drum is of a construction in which the layers of organic photosensitive members obtained by applying a positive charge injection-preventing layer, a charge-generating layer, and a charge-transporting layer in the stated order in a superimposed manner are laminated on a cylinder as an electro-conductive substrate. For example, a polyarylate is used as the charge-transporting layer, and the thickness of the charge-transporting layer is adjusted to about 23 μm. The charge-transporting layer is formed by dissolving a charge-transporting material in a solvent together with a binder. As an organic charge-transporting material, there may be given, for example, an acrylic resin, a styrene-based resin, polyester, a polycarbonate resin, polyarylate, polysulfone, polyphenylene oxide, an epoxy resin, a polyurethane resin, an alkyd resin, and an unsaturated resin. One kind of these charge-transporting materials may be used alone, or two or more kinds thereof may be used in combination.

[Charging Apparatus]

The charging roller constituting the charging apparatus is of, for example, a construction in which an electro-semiconductive rubber layer is arranged on a cored bar as an electro-conductive support, and the electric resistance value of the charging roller is set to, for example, about $10^5\Omega$ when a voltage of 200 V is applied to the electro-conductive photosensitive drum.

[Developing Apparatus]

The developing apparatus 4 includes a toner 12 as a developer, the developer container 13 as a developer-storing portion, the developing roller 14 as a developer carrying member, the supplying roller 15 for supplying the toner to the developing roller, and the regulating blade 16 as a developer-regulating member for regulating the toner on the developing roller. Details about the developing roller are described later. The supplying roller rotates while contacting with the developing roller, and one end of the regulating blade 16 contacts with the developing roller.

The supplying roller 15 is of a construction in which a foamed urethane layer 15*b* is arranged on the periphery of a cored bar electrode 15*a* as an electro-conductive mandrel. The outer diameter of the cored bar electrode is, for example, 5.5 mm. The outer diameter of the entirety of the supplying roller including the foamed urethane layer is, for example, 13 mm. The amount in which the supplying roller and the developing roller penetrate each other is 1.2 mm. The supplying roller rotates in such a direction that the roller and the developing roller have velocities in directions opposite to each other in a portion where the rollers contact with each other. The powder pressure of the toner 12 present around the foamed urethane layer acts on the layer and the supplying roller rotates, whereby the toner is taken in the foamed urethane layer. The supplying roller containing the toner supplies the toner to the developing roller in the contacting portion with the developing roller, and rubs the toner to provide the toner with preliminary triboelectric charge. Meanwhile, the supplying roller for supplying the toner to the developing roller has a role of peeling the toner remaining on the developing roller without being developed in a developing portion.

The toner supplied from the supplying roller to the developing roller reaches the regulating blade, and its charge quantity and layer thickness are adjusted to desired ones. The regulating blade is, for example, a SUS blade having a thickness of 80 μm, and is placed in a direction against the rotation of the developing roller. The amount of the toner on the developing roller is regulated by the regulating blade and hence a uniform toner layer thickness is obtained. In addition, a desired charge quantity is obtained by triboelectric charging based on rubbing. In addition, a voltage having a potential difference of, for example, −200 V with respect to the developing roller is applied to the regulating blade. The potential difference is intended for the stabilization of a toner coat layer.

A toner layer formed on the developing roller by the regulating blade is conveyed to the developing portion contacting with the photosensitive drum, and reversal development is performed in the developing portion. At the contacting position, the amount in which the developing roller penetrates the photosensitive drum is set to, for example, 40 μm by a roller (not shown) in an end portion of the developing roller. The surface of the developing roller is pressed against the photosensitive drum to deform, thereby forming a developing nip. Thus, development can be performed in a stable contacting state. In the developing nip, the developing roller rotates in the same direction as that of the photosensitive drum at a peripheral speed ratio of 117% with respect to the photosensitive drum. It is because such peripheral speed difference has a role of stabilizing the amount of the toner to be developed that the difference is made.

[Developer]

The developer that can be used in the image forming apparatus of the present invention, which is not particularly limited, is, for example, a one-component nonmagnetic toner. The one-component nonmagnetic toner is prepared so as to contain a binder resin and a charge control agent, and is produced so as to have negative polarity through the addition of a fluidizer or the like as an external additive. The toner is produced by a polymerization method and its average particle diameter is adjusted to, for example, about 5 μm.

[Developer Carrying Member]

Figure 4:
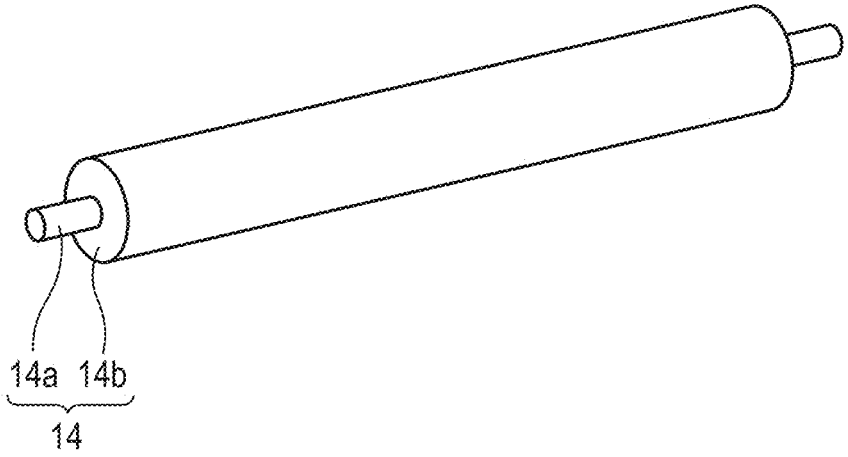
FIG. 4 is a schematic view of a developer carrying member (developing roller) according to the present invention.
Figure 8:
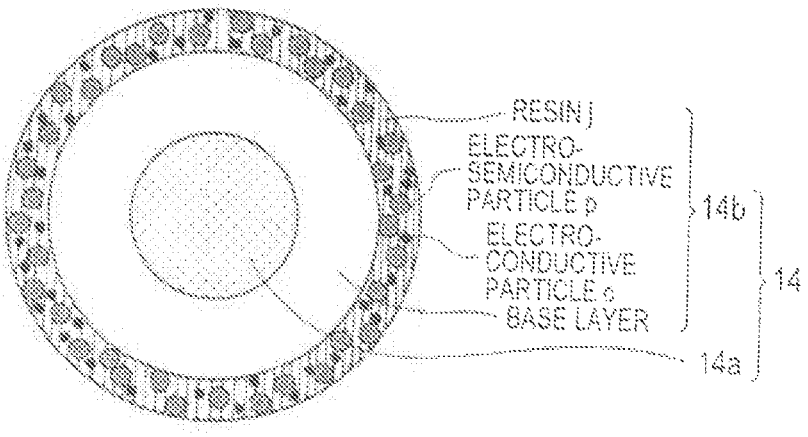
FIG. 8 is a schematic view of the developing roller whose electro-conductive elastic layer contains a resin, an electro-semiconductive particle, and an electro-conductive particle.

A developer carrying member according to the present invention has a role of contacting with an image-bearing member bearing an electrostatic latent image to develop the electrostatic latent image with a developer. Now, the developer carrying member of the present invention is described in detail by way of a developing roller as a typical form of the developer carrying member. As illustrated in FIG. 4, the developing roller has at least an electro-conductive mandrel and an electro-conductive elastic layer. In addition, the roller can have a surface layer as required. An example of a sectional view of the developing roller is illustrated in FIG. 8.

(Electro-Conductive Mandrel)

A material for an electro-conductive mandrel 14*a* is not particularly limited as long as the material is electro-conductive, and a material appropriately selected from carbon steel, alloy steel, cast iron, and an electro-conductive resin can be used. Examples of the alloy steel include stainless steel, nickel-chromium steel, nickel-chromium-molybdenum steel, chromium steel, chromium-molybdenum steel, and nitriding steel having added thereto Al, Cr, Mo, and V.

(Electro-Conductive Elastic Layer)

An electro-conductive elastic layer 14*b* contains at least a resin j, an electro-semiconductive particle p, and an electro-conductive particle c. The electro-conductive elastic layer is arranged for imparting, to the developing roller, elasticity required in an apparatus to be used. The construction of the layer may be specifically, for example, any one of a solid body and a foam. In addition, the elastic layer may be a single layer, or may be formed of a plurality of layers. For example, the developer carrying member is always in press contact with the photosensitive member and the toner, and hence an elastic layer having the following characteristics is arranged for alleviating damage mutually done between these members: low hardness and a low compression set.

[Resin j]

Examples of the resin j include one kind selected from, for example, urethane rubber, chloroprene rubber, isoprene rubber, butadiene acrylonitrile, epichlorohydrin rubber, ethylene propylene rubber, hydrin rubber, fluororubber, natural rubber, butyl rubber, nitrile rubber, polyisoprene rubber, polybutadiene rubber, silicone rubber, styrene-butadiene rubber, ethylene-propylene rubber, chloroprene rubber, and acrylic rubber, and mixtures of two or more kinds thereof. In particular, urethane rubber, chloroprene rubber, butadiene acrylonitrile, epichlorohydrin rubber, or the like is preferred. One kind of these resins may be used alone, or two or more kinds thereof may be used in combination.

[Electro-Semiconductive Particle p]

A material for the electro-semiconductive particle p is, for example, any one of the following materials: metal oxides such as silica, zinc oxide, titanium oxide, aluminum oxide, tin oxide, antimony oxide, indium oxide, and silver oxide. The electroconductivity of the electro-semiconductive particle p is preferably from $1\times10^{-11}$ S/cm to $1\times10^{-3}$ S/cm.

[Electro-Conductive Particle c]

As a material for the electro-conductive particle c, there are given, for example: electro-conductive carbons such as carbon black and acetylene black; carbons for rubber such as SAF, ISAF, HAF, FEF, GPF, SRF, FT, and MT; a carbon for a color subjected to oxidization treatment or the like, a pyrolytic carbon; indium-doped tin oxide (ITO); metals such as copper, silver, and germanium; and electro-conductive polymers such as polyaniline, polypyrrole, and polyacetylene. The electroconductivity of the electro-conductive particle c is preferably from $1\times10^{-2}$ S/cm to $1\times10^{3}$ S/cm. In addition, the content of the electro-conductive particle c in the electro-conductive elastic layer is preferably from 5 mass % to 30 mass %.

In addition, the electro-conductive elastic layer may contain an electroconductivity-imparting agent. Examples of the electroconductivity-imparting agent include the following ion conductive substances: inorganic ion conductive substances such as sodium perchlorate, lithium perchlorate, calcium perchlorate, and lithium chloride; and organic ion conductive substances such as modified fatty acid dimethylammonium ethosulfate, stearic acid ammonium acetate, laurylammonium acetate, and octadecyltrimethylammonium perchlorate salt.

The resin j, the electro-semiconductive particle p, and the electro-conductive particle c incorporated into the electro-conductive elastic layer are preferably a urethane resin, a zinc oxide particle, and a carbon particle, respectively. The electro-conductive elastic layer formed of such material combination has the following advantages: an effect in the present invention is stably obtained and the layer can be produced at a low cost.

In addition, the volume occupancy of the zinc oxide particle in the electro-conductive elastic layer of the above-mentioned construction preferably increases toward the vicinity of the surface of the electro-conductive elastic layer. When the zinc oxide particle is placed in the electro-conductive elastic layer as described above, a reduction in capacitance of the developer carrying member not only exhibits a suppressing effect on the attenuation of the charge of a toner but also improves the charge-providing performance for the toner by the zinc oxide particle. As a result, fogging can be effectively and significantly suppressed.

[Surface Roughness]

As a guideline, the surface roughness of the developing roller is preferably as follows: a center line average roughness Ra in the standard of JIS B 0601:1994 "Surface Roughness" is from 0.3 μm to 5.0 μm. Setting the Ra to 0.3 μm or more can provide an additionally stable developer coating amount and hence contributes to the formation of a high-quality electrophotographic image having a uniform image density.

[Electroconductivity and Dielectric Constant]

In the electro-conductive elastic layer constituting the developer carrying member of the present invention, electroconductivities $\sigma_j$ and $\sigma_p$, and dielectric constants $\in_j$ and $\in_p$ of the resin j and the electro-semiconductive particle p calculated by an AC impedance method have relationships represented by the following formulae (1) and (2).

$$\sigma_j<\sigma_p<0.05 \text{ S/cm} \quad (1)$$

$$\in_p<\in_j \quad (2)$$

Satisfying the relationship of $\sigma_j<\sigma_p$ represented by the formula (1) results in the formation of an electro-conductive path passing the electro-semiconductive particle p, and satisfying the relationship of $\sigma_p<0.05$ S/cm can cause the dielectric characteristics of the electro-semiconductive particle p to act on the electro-conductive path. In addition, the relationship represented by the formula (2) is satisfied and hence the following effect can be obtained: the dielectric characteristics of the electro-semiconductive particle p reduce a capacitance C of the developer carrying member. As a result, the attenuation of the charge of the toner and fogging can be suppressed.

It should be noted that in the formula (1), [S/cm] is the unit of an electroconductivity meaning [siemens per centimeter] and "S" is identical in meaning to "1/Ω".

The thickness of the electro-conductive elastic layer in the present invention is preferably set to be larger than the particle diameter of the electro-semiconductive particle p. Setting the thickness to a value larger than the particle diameter of the electro-semiconductive particle p can effectively suppress the attenuation of the toner charge. In addition, the thickness of the electro-conductive elastic layer is smaller than preferably 0.01 times, particularly preferably 0.003 times the outer diameter of the developer carrying member. Setting the thickness of the electro-conductive elastic layer to a value smaller than 0.01 times the outer diameter of the developer carrying member suppresses an influence of the expansion of the member in its radial direction and hence can enjoy the suppressing effect on the attenuation of the toner charge with additional reliability.

When the volume fractions of the electro-conductive particle c, the electro-semiconductive particle p, and the resin j with respect to the entirety of the electro-conductive elastic layer are defined as Vc, Vp, and Vj, respectively, the ratio Vp/Vc of the Vp to the Vc is preferably larger than 0.5. Setting the ratio Vp/Vc to a value larger than 0.5 suppresses a reduction in ratio of the electro-semiconductive particle p passing the electro-conductive path and hence can reduce the capacitance of the developer carrying member. In addition, the ratio Vp/Vj of the Vp to the Vj is preferably larger than 0.3 and smaller than 0.8. Setting the ratio Vp/Vj to a value larger than 0.3 suppresses a reduction in ratio of the electro-semiconductive particle p to the resin j and hence can reduce the capacitance of the developer carrying member. In addition, setting the ratio Vp/Vj to a value smaller than 0.8 suppresses the agglomeration of the electro-semiconductive particles p and facilitates their uniform dispersion in the resin j, and hence can effectively reduce the capacitance of the developer carrying member. In order that the reducing effect on the capacitance of the developer carrying member in the present invention may be obtained, the ratio Vp/Vj is more preferably larger than 0.4 and smaller than 0.7.

The resistance value of the developer carrying member is desirably from $2\times10^{4}\Omega$ to $5\times10^{7}\Omega$. When the resistance value is $2\times10^{4}\Omega$ or more, the phenomenon in which the quantity of a current flowing through the elastic layer increases and hence a required current quantity becomes excessively large can be suppressed. In addition, when the resistance value is set to $5\times10^{7}\Omega$ or less, a current flowing at the time of development is hardly inhibited. The resistance value of the developer carrying member to be used in the present invention is set to, for example, $5\times10^{5}\Omega$ through the adjustment of the addition amount of the electro-conductive particle.

The resistance value of the developer carrying member is calculated from the result of the measurement of a complex impedance characteristic. Analysis is performed with an equivalent circuit model illustrated in FIG. 6 in which parallel equivalent circuits each having a conductance and a capacitance are connected in series, the value at which an angular frequency ω of a real part Z' of the complex impedance characteristic becomes 0 is derived, and the derived value is defined as the resistance value of the developer carrying member. After the developer carrying member has been left to stand in an evaluation environment (having a temperature of 30° C. and a relative humidity of 80%) for 12 hours, the measurement of the complex impedance characteristic is performed under the environment. For example, "K. S. Zhao, K. Asaka, K. Asami, T. Hanai, Bull. Inst. Chem. Res., Kyoto Univ., 67 225-255 (1989)" is given as a reference relating to the measurement of the complex impedance characteristic.

<Methods of Measuring Conductance and Capacitance Characteristics>

Methods of measuring physical property values to be used in the present invention are described below.

A conductance G, the capacitance C, an electroconductivity σ, and a dielectric constant ∈ are measured with an AC impedance analyzer (manufactured by Solartron, 1260 type impedance analyzer+1296 type dielectric constant-measuring interface). An AC voltage of 500 mV is superimposed on a DC voltage of 20 V, and the complex impedance characteristic is measured with respect to a change in frequency from 1 MHz to 1 Hz. The frequency characteristics of the conductance G and the capacitance C are determined based on relational formulae (3) and (4) concerning the real part Z' and imaginary part Z" of the complex impedance characteristic, and the conductance G, the capacitance C, and the angular frequency ω.

$$G = \frac{Z'}{Z'^2 + Z''^2} \tag{3}$$

$$C = \frac{1}{\omega}\frac{Z''}{Z'^2 + Z''^2} \tag{4}$$

Figure 5:
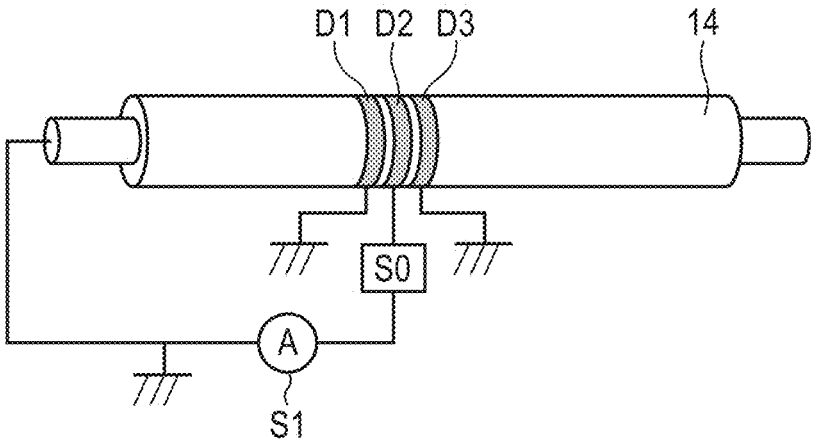
FIG. 5 is a view for illustrating the measurement of the AC impedance of the roller.

The outline of the developer carrying member in the measurement of the complex impedance characteristic is illustrated in FIG. 5. Three electro-conductive tapes each having a width of 15 mm are wound around the surface of the developer carrying member at an interval of 1 mm as illustrated in FIG. 5. An electro-conductive tape D2 positioned at a center out of the three electro-conductive tapes and the mandrel of the developer carrying member are defined as a main electrode, two outside electro-conductive tapes D1 and D3 are defined as guard electrodes, and the electrodes are used in the measurement. After the developer carrying member has been left to stand in an evaluation environment (having a temperature of 30° C. and a relative humidity of 80%) for 12 hours, the measurement of the complex impedance characteristic is performed under the environment.

<Equivalent Circuit Model of Complex Impedance Characteristic>

Figure 6:
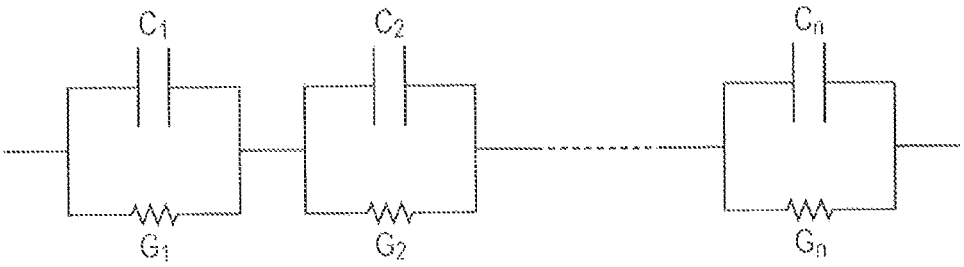
FIG. 6 is a view for illustrating the equivalent circuit model of the developing roller.
Figure 7:
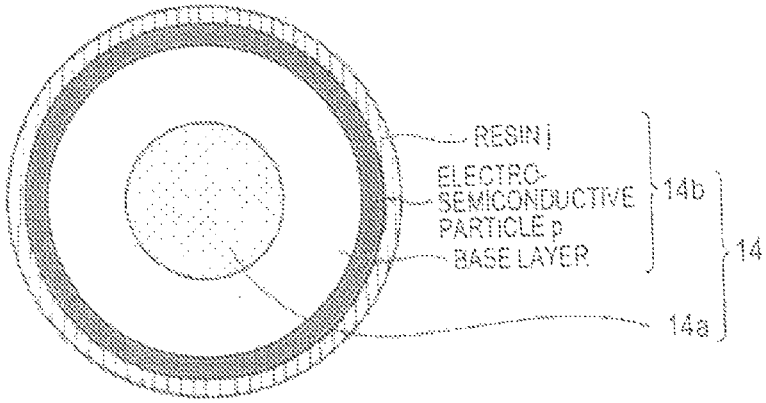
FIG. 7 is a schematic sectional view of a developing roller model whose elastic layer is formed of a three-layer structure.

Conductances $G_1$ to $G_n$ and capacitances $C_1$ to $C_n$ are derived from the complex impedance characteristic through analysis with the equivalent circuit model illustrated in FIG. 6 in which the parallel equivalent circuits of the conductances and the capacitances are connected in series. The analysis is performed with an impedance analysis software Zview (manufactured by Solartron). The inventors of the present invention have made extensive investigations, and as a result, have found that the complex impedance characteristic of a developing roller formed of such constituent materials as illustrated in FIG. 8 can be generally approximated to the complex impedance characteristic of such a developing roller as illustrated in FIG. 7 in which the layer of a material 1 (base layer), the layer of a material 2 (layer of the electro-semiconductive particle p), and the layer of a material 3 (layer of the resin j) are formed around a mandrel. A possible reason for the foregoing is described below based on a developing roller used in Example 1 to be described later. It should be noted that in Example 1, an electro-conductive elastic layer is constituted of a surface layer containing the resin j, the electro-semiconductive particle p, and the electro-conductive particle c, and a base layer.

Figure 12:
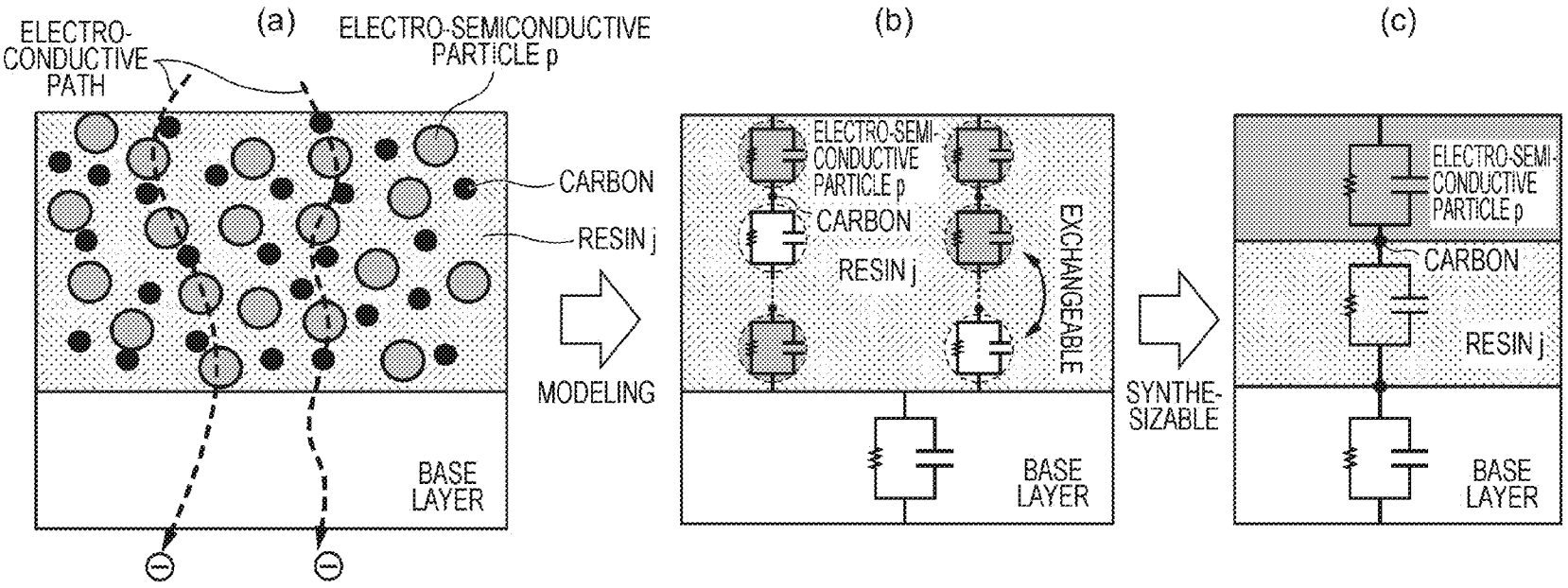
FIG. 12 is a schematic view for illustrating an electro-conductive path in Example 1.

Simply thinking, the electro-conductive path of a current when a material constituting the electro-conductive elastic layer of a developing roller is a system containing mainly carbon, urethane as a resin, and an electro-semiconductive particle like Example 1 is formed by the summation of, for example, electro-conductive paths between carbon and the resin, between carbon and the electro-semiconductive particle, and between the resin and the electro-semiconductive particle like the section (a) of FIG. 12. Meanwhile, a capacitance $C_{tot}$ of the entirety of the roller is represented by $C_{tot}$ ($C_1$, . . . $C_n$, $G_1$, . . . $G_n$). However, when the respective electro-conductive paths are included in a surface layer having a thickness of about 10 μm, an influence of the expansion of the roller in its radial direction can be approximated to a plane, and is substantially equivalent to a suffix. Accordingly, as illustrated in the section (b) of FIG. 12, the $C_{tot}$ does not change even when the order of layers corresponding to the respective electro-conductive paths is changed. Accordingly, when paths of the same kind are mixed in such a series of electro-conductive paths as illustrated in the section (b) of FIG. 12, the electro-conductive paths of the same kind can be integrated into one path as illustrated in the section (c) of FIG. 12. In the developing roller to be used in Example 1, its surface layer alone can be attributed to a two-layer model (urethane and the electro-semiconductive particle p), and layers including the surface layer and a silicone resin layer as the base layer can be attributed to a three-layer model (the silicone resin layer is added). Here, carbon has a low resistance and can be regarded as a conductor, and hence the extent to which carbon affects the analysis of the electrical characteristics of the entirety of the roller is assumed to be small. Therefore, the complex impedance characteristic of a developing roller like this example can be analyzed with such three-layer model as illustrated in the section (c) of FIG. 12. Specifically, the analysis can be performed with a (three-phase) equivalent circuit model in which three parallel equivalent circuits each having a conductance and a capacitance are connected in series. In this example, when the error of the calculation of the layer formed of the electro-semiconductive particle p was 10% or less, the layer was regarded as being attributable to such model.

Next, methods of deriving an electroconductivity $\sigma_i$ and a dielectric constant $\in_i$ corresponding to the conductance $G_i$ and the capacitance $C_i$ thus derived, respectively are described.

<Methods of Deriving Electroconductivity σ and Dielectric Constant ∈>

The electroconductivity σ and the dielectric constant ∈ are calculated from the conductance G=σS/d and the capacitance C=∈S/d derived from the analysis of the complex impedance characteristic by using the following relational formulae (5) and (6).

Figure 9:
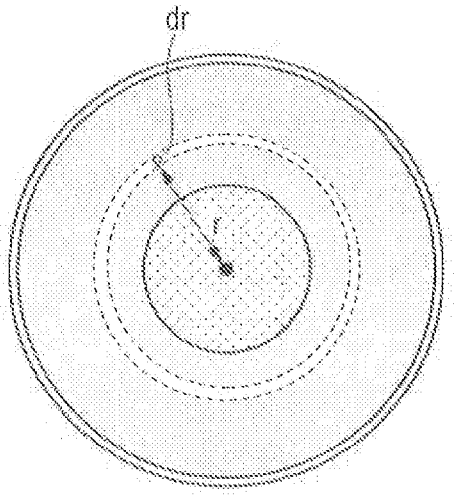
FIG. 9 is a schematic sectional view of the developing roller for illustrating methods of calculating an electroconductivity and a dielectric constant.
Figure 10:
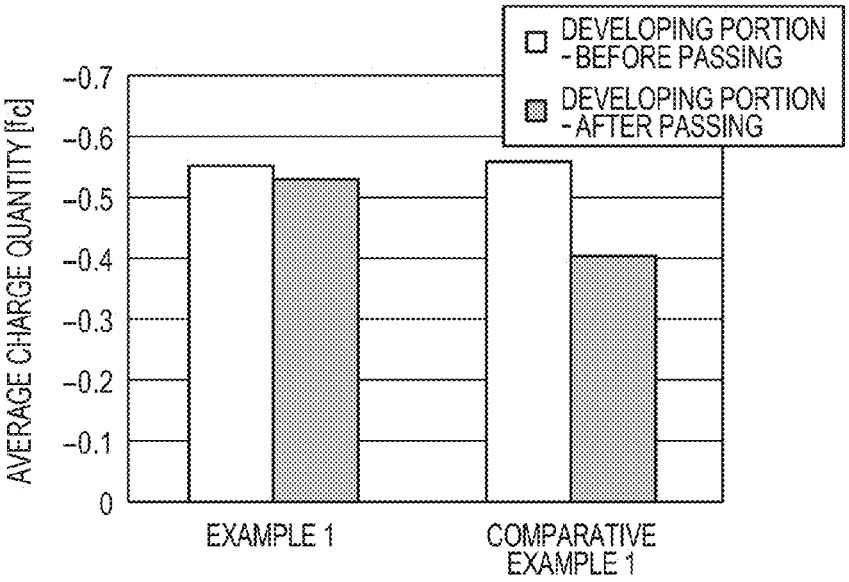
FIG. 10 is a graph for showing the amount of a change in toner charge after passing through a portion where the developing roller and a photosensitive drum contact with each other as compared with toner charge before the passing.

Parameters a, b, and x of each of the relational formulae (5) and (6) are described below by taking FIG. 7 as an example. In order that the electroconductivity σ of the resin j illustrated in FIG. 7 may be calculated, the conductance G derived by the above-mentioned analysis method, a distance from the center of the mandrel to the surface of the base layer as the parameter a, a distance from the center of the mandrel to the surface of the layer of the resin j as the parameter b, and the width of the electro-conductive tape D2 illustrated in FIG. 5 ($=1.5\times10^{-2}$ [m]) as the parameter x are substituted into the relational formula (5). When the dielectric constant ∈ is calculated, the parameters a, b, and x are similarly substituted. Here, $\in_0$ represents a dielectric constant of vacuum and is $8.854\times10^{-12}$ [F/m]. The relational formulae (5) and (6) show that the conductance G and capacitance C of the developer carrying member to be determined are represented by the series connection of a conductance ΔG and a capacitance ΔC of a cylindrical shape having a distance r [m] from the mandrel, a minute thickness dr [m], and an electrode area 2πr·x [$m^2$] illustrated in FIG. 9.

$$\frac{1}{G} = \int_a^b \frac{1}{\Delta G} = \frac{1}{2\pi x\cdot\sigma}\ln\frac{b}{a} \tag{5}$$

$$= \int_a^b \frac{1}{\sigma\cdot\frac{2\pi r\cdot x}{dr}} \quad \therefore \sigma = \frac{G\cdot\ln\frac{b}{a}}{2\pi x}$$

$$= \frac{1}{2\pi x\cdot\sigma}[\ln r]_a^b$$

$$\frac{1}{C} = \int_a^b \frac{1}{\Delta C} = \frac{1}{2\pi x\cdot\varepsilon_0\varepsilon_r}\ln\frac{b}{a} \tag{6}$$

$$= \int_a^b \frac{1}{\varepsilon_0\varepsilon_r\frac{2\pi r\cdot x}{dr}} \quad \therefore \varepsilon_r = \frac{C\cdot\ln\frac{b}{a}}{2\pi x\cdot\varepsilon_0}$$

$$= \frac{1}{2\pi x\cdot\varepsilon_0\varepsilon_r}[\ln r]_a^b$$

Next, methods of calculating the electroconductivity σ and dielectric constant ∈ of the electro-semiconductive particle p in the developing roller illustrated in FIG. 8 formed of the resin j, and the electro-semiconductive particle p and the electro-conductive particle c incorporated into the resin are described. In the developing roller of the construction illustrated in FIG. 8, values estimated from the volume fractions of the electro-semiconductive particle and the electro-conductive particle with respect to the resin are substituted into the parameters a and b of each of the relational formulae (5) and (6). In other words, the construction of FIG. 8 is also approximated to the construction of FIG. 7, and the parameters a and b are calculated from the volume fractions. The volume fractions used here are the volume ratios of the respective materials (the resin j, the electro-semiconductive particle p, and the electro-conductive particle c) with respect to the entirety of the surface layer obtained by the observation of a section of the developing roller with a transmission electron microscope and the identification of the respective materials.

Here, aj and ap of the resin j and the electro-semiconductive particle p each corresponding to the parameter a, and bj and by of the resin and the particle each corresponding to the parameter b are defined as follows: ap=$5.65\times10^{-3}$ [m] (distance from the center of the mandrel to the surface of the base layer), bp=ap+surface layer thickness×(volume fraction of the electro-semiconductive particle), aj=bp, and bj=aj+surface layer thickness×(volume fraction of the resin j).

<Method of Deriving $\sigma_u/\in_u$>

In the electro-conductive elastic layer of the present invention, electroconductivities $\sigma_p$ and $\sigma_u$, and dielectric constants $\in_p$ and $\in_p$ of the electro-semiconductive particle p component and a component u except the electro-semiconductive particle p, the electroconductivities and the dielectric constants being calculated through the separation of the constituent components of the layer into the electro-semiconductive particle p component and the component u except the electro-semiconductive particle p by the AC impedance method, preferably have a relationship represented by the following formula (10). When the relationship represented by the formula (10) is satisfied, the frequency dependence of the capacitance C of the developer carrying member reduces. As a result, the following effect can be obtained: even when the process speed of an image forming apparatus at the time of its image formation is changed, a fogging amount is stably suppressed.

$$|\log_{10}[(\sigma_p/\in_p)/(\sigma_u/\in_u)]|<1.5 \tag{10}$$

Figure 16:
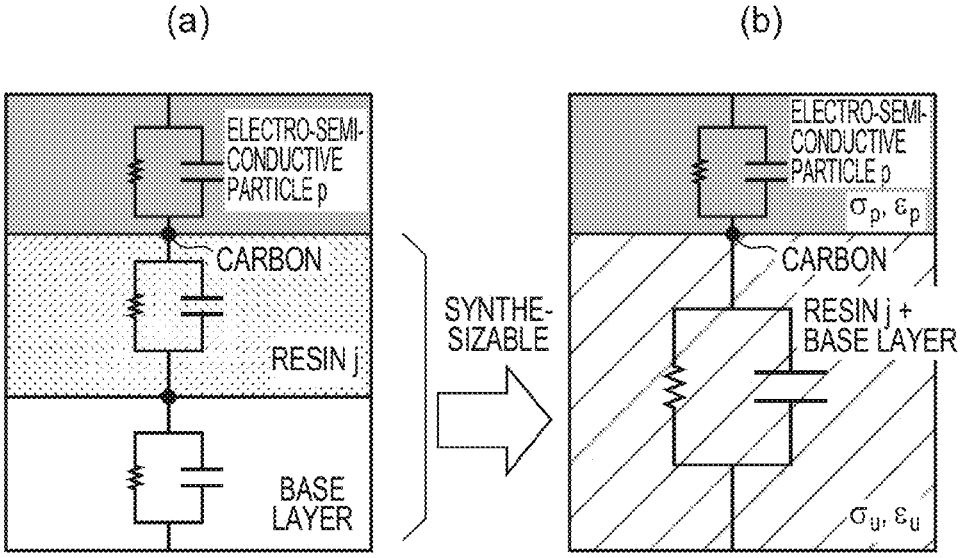
FIG. 16 is a schematic view for illustrating the synthesis of a component except an electro-semiconductive particle p component.

In a developing roller having a complex impedance characteristic described by such three-phase equivalent circuit as illustrated in the section (c) of FIG. 12, when a synthetic layer u of the layers except the electro-semiconductive particle p (resin j+base layer) is considered, the roller can be considered as a two-phase model formed of the electro-semiconductive particle p and the synthetic layer u (FIG. 16). By assuming that the ratio of a conductance $G_u$ of the synthetic layer u to its capacitance $C_u$ is equal to the ratio of the electroconductivity $\sigma_u$ of the synthetic layer to its dielectric constant $\in_u$, the ratio can be represented as follows: $G_u/C_u=\sigma_u/\in_u$. The ratio $\sigma_u/\in_u$ of the synthetic layer u can be calculated by: substituting a conductance G and a capacitance $C_j$ of the resin j, and a conductance $G_b$ and a capacitance $C_b$ of the base layer into the following relational formulae (7) and (8) to calculate the conductance $G_u$ and capacitance $C_u$ of the synthetic layer u; and substituting the parameters into the relational formula (9). Here, $\in_0$ represents a dielectric constant of vacuum and is $8.854\times10^{-12}$ [F/m].

$$C_u = \frac{C_jG_b^2 + C_bG_j^2}{(G_j+G_b)^2} \tag{7}$$

$$G_u = \frac{G_jG_b}{G_j+G_b} \tag{8}$$

$$\frac{\sigma_u}{\varepsilon_u} = \frac{G_u}{C_u}\cdot\varepsilon_0 \tag{9}$$

(Surface Layer)

When the developer carrying member of the present invention has a surface layer on the electro-conductive elastic layer, the same resin as the resin j can be used as a material constituting the surface layer.

<Method of Producing Developer Carrying Member>

A method of producing a developer carrying member according to the present invention, which is not particularly limited, is, for example, a method involving: dispersing and mixing materials for forming an electro-conductive elastic layer in a solvent to prepare a coating material; applying the coating material onto an electro-conductive mandrel; and drying the resultant coating film to solidify the film or curing the film. The following dispersion apparatus may be suitably utilized for dispersing and mixing: a known medium dispersion apparatus such as a ball mill, a sand mill, an attritor, or a bead mill; or a known medium-less dispersion apparatus utilizing a collision-type atomization method or a thin-film spinning method. In addition, the following known method is applicable as an application method for the obtained coating material: a dipping method, a spraying method, a roll coating method, an electrostatic application, or the like.

A method of forming a surface layer that can be formed on the electro-conductive elastic layer as required, which is not particularly limited, is, for example, a method involving: dispersing and mixing each component of the surface layer in a solvent to prepare a coating material; applying the coating material onto the electro-conductive elastic layer; and drying the resultant coating film to solidify the film or curing the film. Any known dispersion apparatus utilizing beads such as a sand mill, a paint shaker, DYNO-MILL, or a pearl mill may be suitably utilized for dispersing and mixing each component. In addition, any known method such as a dipping method, a spraying method, or a roll coating method may be applicable as an application method of the obtained coating material to the electro-conductive elastic layer.

<Image Forming Method>

Image formation by the image forming apparatus of Embodiment 1 can be performed by, for example, the following method.

The amount of a toner to be filled into a developing apparatus is set to, for example, an amount corresponding to such an amount that a converted image having an image ratio of 5% can be printed on 3,000 sheets. The horizontal line having an image ratio of 5% is specifically, for example, such an image that the following pattern is repeated: after a one-dot line has been printed, no lines are printed over 19 dots.

In an image forming process, the photosensitive drum is rotationally driven at a speed of 120 mm/sec by the image forming apparatus in a direction indicated by an arrow r in FIG. 1. In addition, the image forming apparatus has a low-speed mode corresponding to a process speed of 60 mm/sec in order that a quantity of heat for fixation may be secured at the time of the passing of thick recording paper (thick paper). In addition, in this embodiment, the apparatus operates according to only the two kinds of process modes, but may have a plurality of process modes depending on recording paper, and may be constructed so as to be capable of performing control corresponding to each of the process modes.

Next, a specific voltage in this embodiment is described. The surface of the photosensitive drum is uniformly charged to −500 V by applying a voltage of −1,050 V to the charging roller, whereby a dark potential (Vd) is formed. The electric potential of a printing portion is adjusted to −100 V (light potential V1) by laser as exposing means. At this time, a voltage (Vdc) of −300 V is applied to the developing roller to transfer the negative polarity toner into a light potential, whereby reversal development is performed.

In addition, the value of |Vd−Vdc| is referred to as "Vback" and the Vback is set to, for example, 200 V.

Embodiment 2

Figure 3:
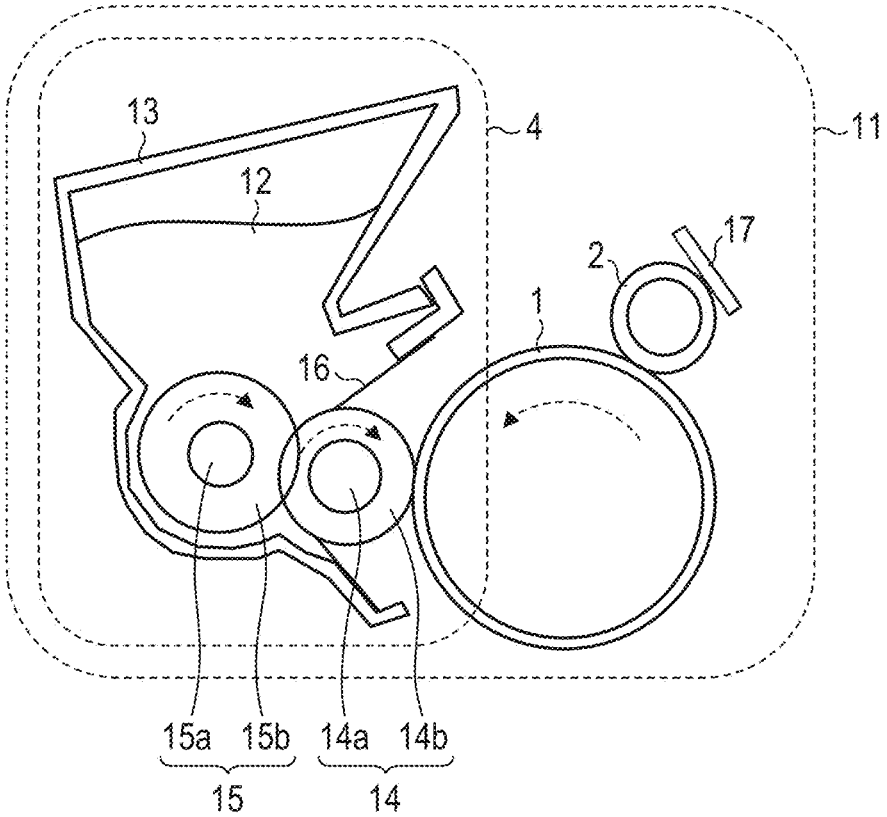
FIG. 3 is a schematic view of the process cartridge according to Embodiment 2.

FIG. 3 is a schematic construction view for illustrating a process cartridge of a second embodiment of the present invention. An image recording apparatus of this embodiment is a laser printer of a toner recycle process (cleaner-less system) utilizing a transfer-type electrophotographic process. The redescription of the same points as those of the image recording apparatus of Embodiment 1 is omitted, and different points are described. A characteristic point in this embodiment lies in that transfer residual toner is recycled without the placement of any cleaning blade. The transfer residual toner is recycled so as not to adversely affect any other process such as charging, whereby the toner is recovered in a developing device. Specifically, the following constructions are changed for Embodiment 1.

The same roller as that of Embodiment 1 is used as the charging roller 2 constituting a charging apparatus, but the charging apparatus further includes a contacting member 17 for the purpose of preventing the charging roller from being contaminated with a toner. Even when the charging roller is contaminated with a toner having polarity (positive polarity) opposite to the charged polarity of the roller, the toner is charged from positive charge to negative charge and the toner is quickly ejected from the charging roller, and hence the toner can be recovered in the developing device by simultaneous development cleaning. For example, a polyimide film having a thickness of 100 μm is used as the contacting member, and is brought into contact with the charging roller at a linear pressure of 10 (N/m) or less. The polyimide has the triboelectric charging characteristic by which the toner is provided with negative charge. In addition, the absolute value of the non-exposure potential Vd and the value of the Vback are set to be large in order that the property by which the toner is recovered in the developing device may be improved. Specifically, the electric potential of the surface of the photosensitive drum is set to the uniform electric potential Vd=−800 V by setting the voltage to be applied to the charging roller to −1,350 V. Further, the Vback is set to 500 V by setting a developing bias to −300 V.

Example 1

A developing roller of a structure illustrated in FIG. 4 was produced as described below.

Used as the electro-conductive mandrel 14*a* was a product obtained by plating a cored bar made of SUS22 having an outer diameter of 6 mm and a length of 26.5 mm with nickel, and applying and baking PRIMER DY35-051 (trade name, manufactured by Dow Corning Toray Silicone Co., Ltd.) to the resultant. The electro-conductive rubber layer 14*b* blended with an electro-conductive particle and an electro-semiconductive particle was arranged on the periphery of the mandrel to set the outer diameter of the developing roller 14 to 11.5 mm. Materials for the rubber layer (electro-conductive elastic layer) were as follows: a first layer was a silicone rubber layer (thickness: 2.74 mm) and a second layer was a urethane layer (thickness: 10 μm). The urethane layer was formed of a ZnO particle as the electro-semiconductive particle, a carbon black particle as the electro-conductive particle, and a urethane resin.

Details about a method of forming the silicone rubber layer, methods of synthesizing a polyol and an isocyanate as raw materials for the urethane resin, and a method of forming the urethane layer are as described below.

[1. Formation of Silicone Rubber Layer]

The electro-conductive mandrel was placed in a cylindrical die having an inner diameter of 11.48 mm so as to be concentric therewith, and an addition-type silicone rubber composition having formulation shown in Table 1 below was injected into a cavity formed in the die. The amount of a silica powder as a filler was adjusted for adjusting the hardness of the entirety of the developing roller.

TABLE 1

| Material | Part(s) by mass |
|---|---|
| Liquid silicone rubber material SE6724A/B (trade name, manufactured by Dow Corning Toray Silicone Co., Ltd.) | 100 |
| Carbon black TOKABLACK #7360SB (trade name, manufactured by Tokai Carbon Co., Ltd.) | 35 |
| Silica powder | 0.2 |
| Platinum catalyst | 0.1 |

Subsequently, the silicone rubber was vulcanized and cured at 150° C. for 15 minutes by heating the die, and was removed from the die. After that, a curing reaction was completed by further heating the resultant at 200° C. for 2 hours. Thus, the silicone rubber layer having a thickness of 2.74 mm was arranged on the outer periphery of the electro-conductive mandrel.

[2. Synthesis of Polyol]

100 Parts by mass of a polytetramethylene glycol PTG1000SN (trade name, manufactured by Hodogaya Chemical Co., Ltd.) was mixed with 20 parts by mass of an isocyanate compound MILLIONATE MT (trade name, manufactured by Nippon Polyurethane Industry Co., Ltd.) in a methyl ethyl ketone (MEK) solvent in a stepwise manner. The mixed solution was subjected to a reaction under a nitrogen atmosphere at 80° C. for 7 hours to produce a polyether polyol having a hydroxyl value of 20 [mgKOH/g].

[3. Synthesis of Isocyanate]

Under a nitrogen atmosphere, 100 parts by mass of a polypropylene glycol having a number-average molecular weight of 400 (trade name: EXCENOL, manufactured by Asahi Glass Co., Ltd.) was caused to react with 57 parts by mass of coarse MDI (trade name: COSMONATE M-200, manufactured by Mitsui Chemical Polyurethane) at 90° C. for 2 hours under heat. After that, butyl cellosolve was added to the resultant so that a solid content became 70 mass %. Thus, an isocyanate compound having a mass ratio of an NCO group incorporated per unit solid content of 5.0 mass % was obtained. After that, 22 parts by mass of MEK oxime was dropped to the compound under the condition of a reactant temperature of 50° C. Thus, a blocked polyisocyanate was obtained.

[4. Production of Application Liquid for Forming Urethane Layer]

The polyol produced as described above was mixed with the blocked polyisocyanate so that an NCO/OH group ratio became 1.4. Thus, a raw material for a "polyurethane A" as a resin component was obtained. 100 Parts by mass of the resin solid content of the mixture was mixed with a carbon black particle and a ZnO particle (A) shown in Table 2 below, the volumes of the ZnO particle and the carbon black particle were adjusted to the same value, and the materials were dissolved or dispersed in MEK so that their total solid content became 40 mass %, followed by mixing. The mixed liquid was dispersed and mixed with glass beads each having a particle diameter of 0.5 mm in a sand mill for 6 hours to produce an application liquid for forming the urethane layer.

TABLE 2

| Material | Part(s) by mass |
|---|---|
| Mixture of polyol and blocked polyisocyanate (NCO/OH group ratio = 1.4) | 100 |
| Carbon black particle (trade name: MA100, manufactured by Mitsubishi Chemical Corporation, pH = 3.5) | 17 |
| ZnO particle (trade name: MZ-303S, manufactured by Tayca Corporation, particle diameter: 35 nm) | 50 |

[5. Formation of Urethane Layer on Silicone Rubber Layer]

The application liquid for forming the urethane layer obtained as described above was loaded into the application liquid tank of a dipping application apparatus, and the roller with the silicone layer was immersed in the application liquid tank while its uppermost portion was held with its longitudinal direction defined as a vertical direction. Next, the roller was lifted from the inside of the application liquid tank. Conditions such as the speed at which the roller was lifted were appropriately set so that the thickness of the urethane layer became a desired value. The roller having the urethane layer applied onto the silicone layer thus obtained was air-dried at room temperature for 30 minutes, and was then thermally treated in a hot air-circulating oven at 140° C. for 2 hours and 30 minutes to provide the developing roller having a polyurethane layer on the surface of the silicone layer.

[6. Calculation of Electroconductivity σ and Dielectric Constant ∈]

In the developing roller of this example, the resin j is the urethane resin (polyurethane A), the electro-semiconductive particle p is the ZnO particle (A), and the base layer is the silicone rubber. The values of the electroconductivities $\sigma_j$ and $\sigma_p$ of the resin j and electro-semiconductive particle p of the developing roller calculated by the AC impedance method were $1.2\times10^{-10}$ S/cm and $1.4\times10^{-9}$ S/cm, respectively, and the values of the dielectric constants $\in_j$ and $\in_p$ thereof calculated by the method were 20 and 8, respectively. Those electric parameters satisfy the relational formulae (1) and (2).

It should be noted that both the volume fractions of the urethane resin and the ZnO particle forming the urethane layer were 0.5, and hence the calculation was performed by setting the values of the parameters a of the urethane resin, the ZnO particle, and the base layer to $5.65\times10^{-3}$ [m], $5.65\times10^{-3}$ [m], and $3\times10^{-3}$ [m], respectively, and the values of the parameters b thereof to $5.7\times10^{-3}$ [m], $5.7\times10^{-3}$ [m], and $5.65\times10^{-3}$ [m], respectively.

[7. Calculation of $\sigma_u/\in_u$]

In this example, the respective parameters of the resin j and the base layer b calculated by a complex impedance method were as follows: $G_j=3.9\times10^{-6}$ [S], $C_j=6.8\times10^{-10}$ [F], $G_b=7.7\times10^{-4}$ [S], $C_b=5.9\times10^{-11}$ [F], $G_u/C_u=5.7\times10^{3}$ [S/F], and $\sigma_u/\in_u=5.1\times10^{-10}$ [S/cm].

It should be noted that in the following examples and comparative examples as well, the respective impedance characteristic parameters were similarly calculated.

Example 2

22 Parts by mass of a $SiO_2$ particle (trade name: MSP-009, manufactured by Tayca Corporation, particle diameter: 80 nm) was used as the electro-semiconductive particle p. The volumes of the carbon black particle and the $SiO_2$ particle to be dispersed in the urethane resin were adjusted so as to be equal to each other. A developing roller 2 was produced under the same conditions as those of Example 1 except the foregoing.

Comparative Example 1

The outer periphery of the silicone rubber layer (thickness: 2.74 mm) was coated with a urethane resin layer (thickness: 10 μm) having dispersed therein a roughening particle and a conductive agent as a coating layer. A developing roller C1 was produced under the same conditions as those of Example 1 except the foregoing.

Comparative Example 2

A $TiO_2$ particle (trade name: MT-700B, manufactured by Tayca Corporation, particle diameter: 80 nm) was used as the electro-semiconductive particle p to be incorporated into the urethane layer as the second layer, and was used in an amount of 33 parts by mass with respect to 100 parts by mass of the polyol. The usage of the $TiO_2$ particle was adjusted so that the volumes of the carbon black particle and the $TiO_2$ particle to be dispersed in urethane were equal to each other. A developing roller C2 was produced under the same conditions as those of Example 1 except the foregoing.

Example 3

A ZnAlO particle (trade name: Pazet CK, manufactured by Hakusuitech Co., Ltd., particle diameter: 35 nm) was used as the electro-semiconductive particle p to be incorporated into the urethane layer as the second layer, and was used in an amount of 50 parts by mass with respect to 100 parts by mass of the polyol. The usage of the ZnAlO particle was adjusted so that the volumes of the carbon black particle and the ZnAlO particle to be dispersed in urethane were equal to each other. A developing roller 3 was produced under the same conditions as those of Example 1 except the foregoing.

Example 4

The polyol and the blocked polyisocyanate used in Example 1 were mixed so that an NCO/OH group ratio became 0.9. Thus, a raw material for a "polyurethane B" as a resin component was obtained. A developing roller 4 was produced in the same manner as in Example 1 except that the urethane raw material was used as a urethane raw material.

Comparative Example 3

A ZnGaO particle (trade name: Pazet GK-40, manufactured by Hakusuitech Co., Ltd., particle diameter: 35 nm) was used as the electro-semiconductive particle p to be incorporated into the urethane layer as the second layer, and was used in an amount of 50 parts by mass with respect to 100 parts by mass of the polyol. The usage of the ZnGaO particle was adjusted so that the volumes of the carbon black particle and the ZnGaO particle to be dispersed in urethane were equal to each other. A developing roller C3 was produced under the same conditions as those of Example 1 except the foregoing.

Comparative Example 4

An $Al_2O_3$ particle (trade name: SERATH, manufactured by KINSEI MATEC CO., LTD., particle diameter: 35 nm) was used as the electro-semiconductive particle p to be incorporated into the urethane layer as the second layer, and was used in an amount of 50 parts by mass with respect to 100 parts by mass of the polyol. The usage of the $Al_2O_3$ particle was adjusted so that the volumes of the carbon black particle and the $Al_2O_3$ particle to be dispersed in urethane were equal to each other. A developing roller C4 was produced under the same conditions as those of Example 1 except the foregoing.

Example 5

A ZnO particle (B) (trade name: LPZINC-2, manufactured by SAKAI CHEMICAL INDUSTRY CO., LTD., volume-average particle diameter: 2 μm) was used as the electro-semiconductive particle p to be incorporated into the urethane layer as the second layer, and was used in an amount of 50 parts by mass with respect to 100 parts by mass of the polyol. A developing roller 5 was produced under the same conditions as those of Example 1 except the foregoing.

Example 6

A urethane resin (product name: UREARNO, model number: KL-593, manufactured by Arakawa Chemical Industries, Ltd.) was used as a raw material for a "polyurethane C" as a resin for forming the urethane layer as the second layer. In addition, the same particles as those of Example 1 were used as the electro-semiconductive particle and the electro-conductive particle to be incorporated into the resin. 100 Parts by mass of the urethane resin was mixed with 1.8 parts by mass of the carbon black particle and 5.4 parts by mass of the ZnO particle (A), and isopropyl alcohol was added to the mixture so that the total solid content became 40 mass %. The mixed liquid was mixed with glass beads each having a particle diameter of 0.5 mm, and the materials were dispersed and mixed in a sand mill for 6 hours to produce an application liquid for forming the urethane layer. The application liquid for forming the urethane layer obtained as described above was applied onto the silicone layer with a dipping application apparatus by dipping, and was air-dried at room temperature for 30 minutes. After that, the dried product was thermally treated in a hot air-circulating oven at 80° C. for 30 minutes to form the urethane layer. A developing roller 6 was produced in the same manner as in Example 1 except the foregoing.

Example 7

The same urethane resin as that of Example 6 was used as the resin for forming the urethane layer as the second layer. In addition, the same ZnO particle (B) as that of Example 5 was used as the electro-semiconductive particle to be incorporated into the resin, and the same carbon black particle as that of Example 1 was used as the electro-conductive particle to be incorporated into the resin. 100 Parts by mass of the urethane resin was mixed with 1.8 parts by mass of the carbon black particle and 5.4 parts by mass of the ZnO particle (B), and isopropyl alcohol was added to the mixture so that the total solid content became 40 mass %. A developing roller 7 was produced in the same manner as in Example 6 except the foregoing.

Example 8

Materials for electro-conductive elastic layers were as follows: a first layer was a silicone rubber layer (thickness: 3.0 mm), a second layer was a urethane intermediate layer (thickness: 9 μm), and a third layer was a urethane outermost surface layer (thickness: 1 μm). The same materials as those of Example 7 were used as the electro-semiconductive particle p and the electro-conductive particle c to be incorporated into each of the second and third electro-conductive elastic layers. In the urethane intermediate layer, 5.4 parts by mass of the ZnO particle (B) and 1.8 parts by mass of the carbon black particle were incorporated into 100 parts by mass of the raw material for the "polyurethane C." In addition, in the urethane outermost surface layer, 10.8 parts by mass of the ZnO particle (B) and 1.8 parts by mass of the carbon black particle were incorporated into 100 parts by mass of the raw material for the "polyurethane C." A developing roller was produced under the same conditions as those of Example 7 except the foregoing.

It should be noted that the thickness of each of the urethane intermediate layer and the urethane outermost surface layer was adjusted to a desired thickness by adjusting the speed at which the roller was lifted at the time of film formation.

[Evaluation Method]

Each of the developing rollers produced in Examples 1 to 8 and Comparative Examples 1 to 4 was attached to each of the cartridge of Embodiment 1 illustrated in FIG. 2 and the cartridge of Embodiment 2 illustrated in FIG. 3, and the following image evaluations were performed. The results of the evaluations are shown in Table 3. It should be noted that the notation "E−n" means "$\times 10^{-n}$".

[1. Evaluation Method in Embodiment 1]

(Evaluation for Endurance Fogging)

An evaluation for a fogging amount was performed by the following method.

An image forming apparatus was stopped during the printing of a solid white image. A toner on a photosensitive drum after development and before transfer was transferred onto a transparent tape once, and the tape having adhered thereto the toner was bonded to recording paper or the like. In addition, a tape to which no toner had adhered was simultaneously bonded onto the same recording paper. An optical reflectance $R_1$ was measured from above the tape bonded to the recording paper with the green filter of an optical reflectance-measuring machine (TC-6DS manufactured by Tokyo Denshoku Co., Ltd.), and a value "$R_0$-$R_1$" obtained by subtracting the measured value from an optical reflectance $R_0$ of the tape to which no toner had adhered was defined as a fogging amount. The measurement was performed at three or more points on the tape, and the average of the three measured values was determined as the fogging amount and ranked as any one of A to E by the following criteria.

A: The fogging amount is less than 1.0%.

B: The fogging amount is 1.0% or more and less than 3.0%.

C: The fogging amount is 3.0% or more and less than 5.0%.

D: The fogging amount is 5.0% or more and less than 7.0%.

E: The fogging amount is 7.0% or more.

An evaluation for "endurance fogging" was performed after a printing test had been performed on 3,000 sheets in a test environment (having a temperature of 30° C. and a relative humidity of 80%), and then the image forming apparatus had been left to stand for 24 hours. The printing test was performed by continuously passing sheets each having a horizontal line-recorded image having an image ratio of 5%. Here, the horizontal line having an image ratio of 5% is such an image that the following pattern is repeated: after a one-dot line has been printed, no lines are printed over 19 dots. In addition, the printing test was performed according to a normal-speed mode (120 mm/sec), and the evaluation for fogging was performed according to each of the normal-speed mode (120 mm/sec) and a low-speed mode (60 mm/sec).

[2. Evaluation Method in Embodiment 2]

(2-1. Evaluation for Endurance Fogging in Low-Speed Mode when No Cleaner is Used)

In this evaluation, the evaluation for "endurance fogging" performed according to the low-speed mode (60 mm/sec) after the printing test had been performed on the 3,000 sheets in Embodiment 1 was performed. This evaluation is in conformity with the evaluation for endurance fogging in Embodiment 1.

(2-2. Evaluation for Initial Halftone Density when No Cleaner is Used)

This evaluation was performed after an image forming apparatus had been left to stand in an evaluation environment (having a temperature of 30° C. and a relative humidity of 80%) for 24 hours to be conformed to the environment, and then an image had been printed on 100 sheets. The 100-sheet printing test was performed by continuously passing sheets each having a horizontal line-recorded image having an image ratio of 5%. An image evaluation was performed as described below. A halftone image was printed on 1 sheet. Next, 10 sheets each having a vertical stripe image having a width of 2 cm were continuously passed, and a halftone image was printed on an 11th sheet as well by continuous paper passing. Further, sheets each having the vertical stripe image having a width of 2 cm were continuously passed, and a halftone image was printed on a 21st sheet as well by continuous paper passing. The printing test and the output of an image to be evaluated were performed according to a monochromatic mode, and the image was output according to the normal-paper mode (120 mm/sec). The result of the evaluation was ranked as any one of A to C by the following criteria.

A: A density difference between the halftone images on the 1st sheet and the 21st sheet cannot be visually recognized.

B: A density difference between the halftone images on the 1st sheet and the 21st sheet can be visually recognized, but a density difference between the halftone images on the 1st sheet and the 11th sheet cannot be visually recognized.

C: A density difference between the halftone images on the 1st sheet and the 11th sheet can be visually recognized.

In this evaluation, the halftone image means a striped pattern in which a 1 line is recorded in a main scanning direction and then no recording is performed over 4 lines, and the image represents a halftone density as a whole.

TABLE 3

| | Electro-conductive elastic layer | | | Electro-conductivity σ [S/cm] | | Dielectric constant ε | | |
|---|---|---|---|---|---|---|---|---|
| | Electro-Semiconductive particle p | Resin j | Electro-Conductive particle c | $\sigma_p$ | $\sigma_j$ | $\epsilon_p$ | $\epsilon_j$ | $\sigma_p/\epsilon_p$ |
| Example 1 | ZnO (A) | Urethane A | Carbon | 1.40E−09 | 1.20E−10 | 8 | 20 | 1.80E−10 |
| Comparative Example 1 | — | Urethane A | Carbon | — | 1.20E−10 | — | 20 | — |
| Comparative Example 2 | $TiO_2$ | Urethane A | Carbon | 1.00E−07 | 1.20E−10 | 60 | 20 | 1.70E−09 |
| Comparative Example 3 | ZnGaO | Urethane A | Carbon | 5.00E−02 | 1.20E−10 | 8 | 20 | 6.30E−03 |
| Comparative Example 4 | $Al_2O_3$ | Urethane A | Carbon | 2.00E−12 | 1.20E−10 | 15 | 20 | 1.30E−13 |
| Example 2 | $SiO_2$ | Urethane A | Carbon | 1.60E−10 | 1.20E−10 | 12 | 20 | 1.30E−11 |
| Example 3 | ZnAlO | Urethane A | Carbon | 1.00E−07 | 1.20E−10 | 8 | 20 | 1.30E−08 |
| Example 4 | ZnO (A) | Urethane B | Carbon | 1.40E−09 | 1.36E−09 | 8 | 30 | 1.80E−10 |
| Example 5 | ZnO (B) | Urethane A | Carbon | 1.50E−10 | 1.20E−10 | 6 | 20 | 2.50E−11 |
| Example 6 | ZnO (A) | Urethane C | Carbon | 1.40E−09 | 4.70E−12 | 8 | 10 | 1.80E−10 |
| Example 7 | ZnO (B) | Urethane C | Carbon | 1.50E−10 | 4.70E−12 | 6 | 10 | 2.50E−11 |
| Example 8 | Surface ZnO (B) | Urethane C | Carbon | 1.50E−10 | 4.70E−12 | 6 | 10 | 2.50E−11 |

| | Requirement of formula | | | Embodiment 1 | | Embodiment 2 | |
|---|---|---|---|---|---|---|---|
| | Formula (1) | Formula (2) | Value of left side of formula (10) | Normal speed | Low speed | Endurance fogging (low speed) | Halftone density (normal speed) |
| Example 1 | Satisfied | Satisfied | 0.5 | B | B | A | A |
| Comparative Example 1 | — | — | — | C | D | E | C |

TABLE 3-continued

| | | | | | | | |
|---|---|---|---|---|---|---|---|
| Comparative Example 2 | Satisfied | No | 0.5 | C | D | E | C |
| Comparative Example 3 | No | Satisfied | 7.1 | C | D | E | C |
| Comparative Example 4 | No | Satisfied | 3.6 | C | D | E | C |
| Example 2 | Satisfied | Satisfied | 1.6 | B | B | C | B |
| Example 3 | Satisfied | Satisfied | 1.4 | B | B | C | A |
| Example 4 | Satisfied | Satisfied | 0.9 | B | B | B | A |
| Example 5 | Satisfied | Satisfied | 1.3 | B | B | C | A |
| Example 6 | Satisfied | Satisfied | 0.7 | B | B | B | A |
| Example 7 | Satisfied | Satisfied | 0.2 | A | A | B | A |
| Example 8 | Satisfied | Satisfied | 0.2 | A | A | A | A |

[Discussion of Results of Evaluations]

[1. Superiority of the Present Invention Over Related Art]

First, the superiority of the present invention over Comparative Example 1 as related art is described. In Embodiment 1, the fogging amount increases in Comparative Example 1 as compared with Example 1. A reason for the foregoing is described. A toner having charge is conveyed to a developing portion contacting with a photosensitive drum by a developing roller. During the printing of a solid white image, in the contacting portion between the photosensitive drum and the developing roller, an electric field is applied to the charge on the toner in a direction flowing toward the developing roller. Under a high-humidity environment, the respective resistances of the toner and the developing roller reduce, and hence a situation where the attenuation of the charge is remarkably liable to occur toward the developing roller is established. In addition, after the endurance running of an image forming apparatus, the chargeability of the toner reduces owing to the deterioration of the toner. Accordingly, when a reduction in charge of the toner occurs in the developing portion, the control with the electric field becomes difficult and the transfer of the toner onto the white character-printing region of the photosensitive drum accelerates, and hence fogging increases. In Comparative Example 1, the fogging amount increases by the foregoing reason. In addition, when the resistance of the developing roller is increased, the density and gradation change. In contrast, in the present invention, the attenuation of the charge of the toner is suppressed by maintaining the average resistance at a proper value, and hence the fogging amount can be significantly suppressed without any image fluctuation.

Mechanisms for the suppression of the attenuation of the toner charge and the suppression of the fogging in the developing portion of the present invention are considered as described below. During the printing of the solid white image, in the developing portion, an electric field is applied to the toner having charge on the developing roller in the direction in which the charge escapes toward the developing roller. A DC voltage is applied between the developing roller and the photosensitive drum, but each toner particle on the developing roller passes a region to which the electric field is applied only when the particle passes the developing portion, and hence the toner itself can be attributed to a model that temporarily receives an AC electric field (FIG. 15).

Figure 15:
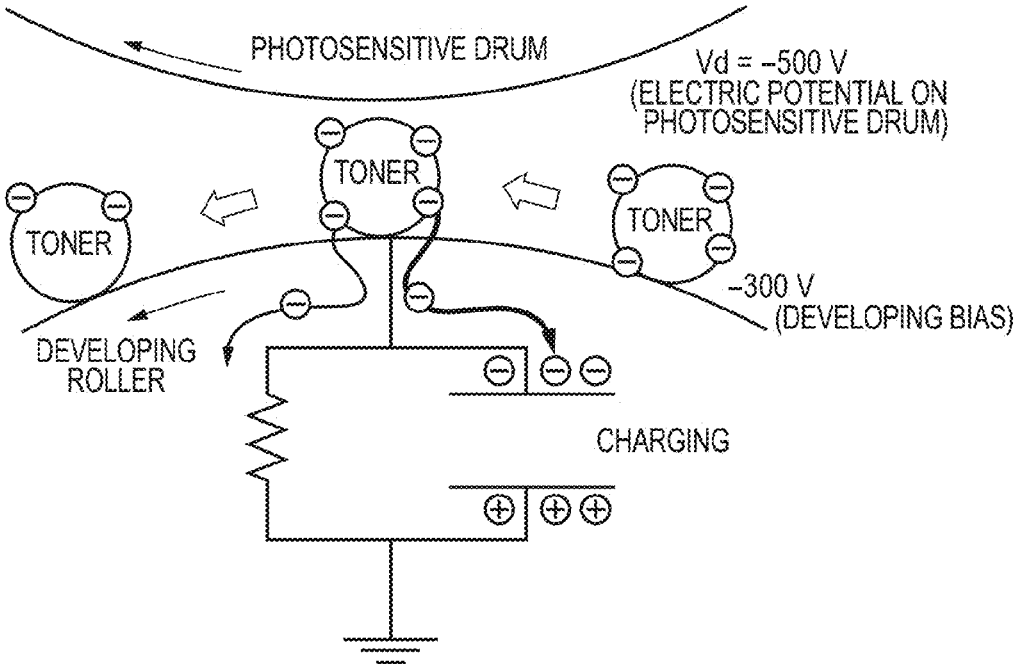
FIG. 15 is a schematic view for illustrating the attenuation of the toner charge between the developing roller and the photosensitive drum.

Accordingly, like FIG. 15, the capacitance component of the developing roller is considered as a factor of the attenuation of the charge of the toner. In Example 1, however, the capacitance component of the developing roller can be appropriately reduced and hence the attenuation of the toner charge can be effectively suppressed. In addition, when the apparatus has a mode in which a process speed is slow, a time period required for the toner particle to pass the developing portion lengthens and hence the attenuation of the toner charge is additionally accelerated. In Comparative Example 1, the fogging worsens at the time of the low-speed mode. In contrast, in Example 1, a reduction in capacitance is maintained even in a low-frequency region and hence the fogging amount can be effectively suppressed. Further, Embodiment 2 is an embodiment in which a cleaner container is removed, and the toner that cannot be transferred and hence remains on the photosensitive drum passes a charging portion to be recovered in the developing portion, and the value of the Vback is set to be as large as 500 V in order that the property by which the toner is recovered may be improved. In this case, the electric field to be applied to the toner in the developing portion increases and hence the attenuation of the toner charge is additionally accelerated. Accordingly, in Comparative Example 1, an increase in fogging amount occurs to a larger extent than that in Embodiment 1, but in Example 1, the fogging amount can be significantly suppressed. In addition, in Comparative Example 1, the amount of the toner remaining after the transfer due to a fogging toner is large, and hence the charging roller is contaminated with the toner, a fluctuation in its charging ability occurs, and a halftone image density fluctuates. In contrast, in Example 1, the contamination of the charging roller with the fogging toner can also be suppressed and hence a satisfactory halftone image density can be obtained.

[2. Superiority of the Present Invention Over Comparative Technology]

Next, the superiority of the present invention is described by comparing the present invention with a comparative technology.

Figure 13:
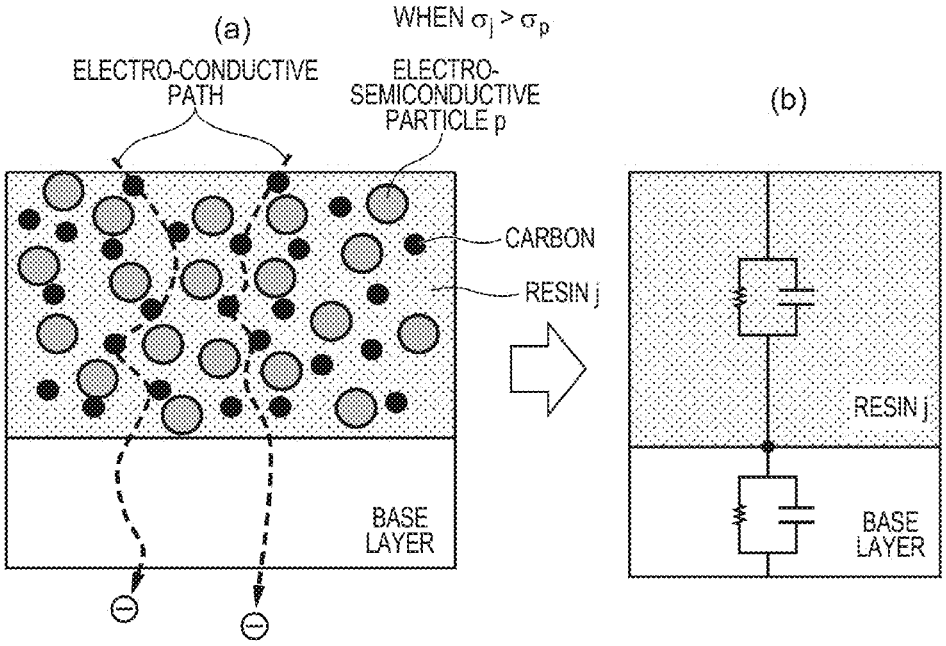
FIG. 13 is a schematic view for illustrating the electro-conductive path when $\sigma_j > \sigma_p$.
Figure 14:
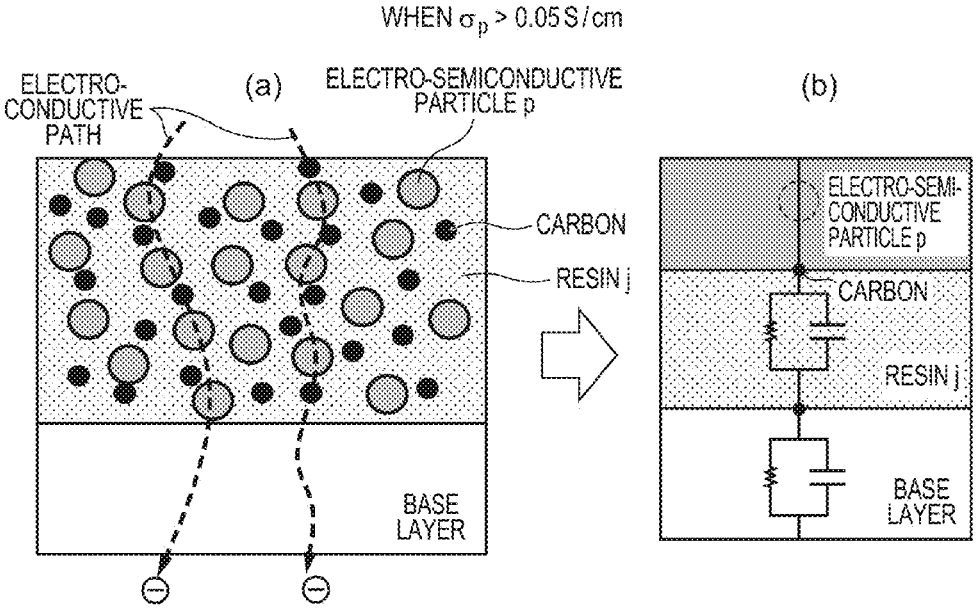
FIG. 14 is a schematic view for illustrating the electro-conductive path when $\sigma_p > 0.05$ S/cm.

First, Comparative Examples 3 and 4 that do not satisfy the formula (1) are described. Comparative Example 4 is an example in which the electroconductivity $\sigma_p$ of the electro-semiconductive particle p calculated from the complex impedance method is smaller than the electroconductivity $\sigma_j$ of the resin. In this case, as illustrated in FIG. 13, the average resistance is increased by the electro-semiconductive particle p but a substantial electro-conductive path does not change. On the other hand, Comparative Example 3 is an example in which the electroconductivity $\sigma_p$ of the electro-semiconductive particle p calculated from the complex impedance method is larger than $5\times10^{-2}$ [S/cm]. When the electroconductivity $\sigma_p$ of the electro-semiconductive particle p is large to be comparable to the numerical value, its conduction may be equivalent to the conduction of carbon and hence the substantial electro-conductive path is equivalent to that of Comparative Example 1 (FIG. 14). Therefore, in Comparative Examples 3 and 4 in which the electro-semiconductive particle p is substantially free from being involved, the capacitance component of the developing roller cannot be reduced and hence their results of the evaluations are equivalent to those of Comparative Example free of any electro-semiconductive particle. On the other hand, Example 1 as the present invention satisfies the formula (1) and hence the electro-semiconductive particle p is involved in the electro-conductive path. Accordingly, a reduction in capacitance of the entirety of the developing roller is realized, and hence in each of Embodiments 1 and 2, the fogging amount can be significantly suppressed.

On the other hand, the results of the evaluations for fogging of Comparative Example 2 are equivalent to those of Comparative Example 1 as the related art in spite of the fact that Comparative Example 2 satisfies the formula (1). A possible reason for the foregoing is that Comparative Example 2 does not satisfy the formula (2). In Comparative Example 2, the dielectric constant $\in_p$ of the electro-semiconductive particle calculated from the complex impedance method is larger than the dielectric constant $\in_j$ of the resin, and hence as described above, the capacitance component of the entirety of the developing roller may increase at the time of the formation of the substantial electro-conductive path. The results of the evaluations are equivalent to those of Comparative Example 1 but slightly worsen as compared with those of Comparative Example 1. As described above, in the present invention, when a relationship between the electroconductivities calculated from the complex impedance method satisfies the formula (1), the electro-semiconductive particle p is involved in the substantial electro-conductive path, and when a relationship between the dielectric constants calculated from the complex impedance method satisfies the formula (2), the capacitance of the entirety of the developing roller can be reduced, whereby the fogging can be stably suppressed.

[3. Comparison Between Examples]

Examples 1 to 8 are compared with one another in order that the effect in the present invention may be described. All of Examples 1 to 8 each satisfy the relational formulae (1) and (2), and hence the capacitance of the entirety of the developing roller can be reduced as compared with that of Comparative Example 1 as the related art and the results of the evaluations for endurance fogging in Embodiment 1 are satisfactory. On the other hand, in Embodiment 2, the Vback is large, and hence a state where the charge on the toner is liable to attenuate toward the developing roller is established and a slight increase in endurance fogging (low speed) is observed. A reason for the foregoing is described below.

At the time of a low process speed, a time period required for the toner on the developing roller to pass the developing portion contacting with the photosensitive drum lengthens, and hence a state where the charge of the toner is liable to attenuate is established. In other words, the foregoing means that the charging of the capacitance component of the developing roller is liable to proceed. Further, in Embodiment 2, a voltage to be applied to the developing portion is set to a value larger than that in Embodiment 1 in the direction in which the charge attenuates toward the developing roller. Accordingly, the capacitance component of the entirety of the developing roller needs to be additionally suppressed and the capacitance component of the entirety of the developing roller needs to be suppressed particularly in a low-frequency band.

The inventors have made extensive investigations, and as a result, have found that as the value of the left side of the formula (10) reduces, an increase in capacitance can be suppressed to a larger extent in the low-frequency band. The value of the ratio [electroconductivity $\sigma$]/[dielectric constant $\in$] calculated by the impedance method is known to be proportional to a relaxation frequency. When it is assumed that an electro-conductive component and a dielectric component form a parallel circuit, the relaxation frequency describes whether the circuit is electro-conductive or dielectric; when the relaxation frequency is large, the circuit is electro-conductive, and when the relaxation frequency is small, the circuit is dielectric.

The case where a plurality of layers to be separated by the impedance method occur like this example can be attributed to a circuit model in which the plurality of parallel circuits each having the electro-conductive component and the dielectric component are arranged in series (section (a) of FIG. 16).

Figure 17A:
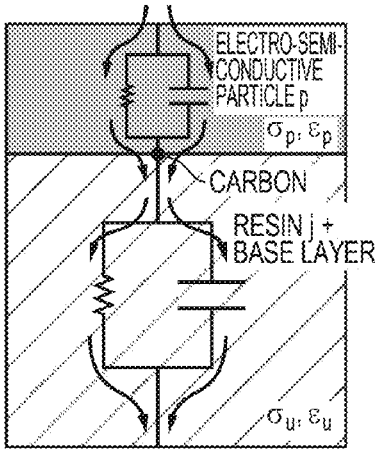
FIG. 17A is a schematic view for illustrating a difference in charging process of charge.
Figure 17B:
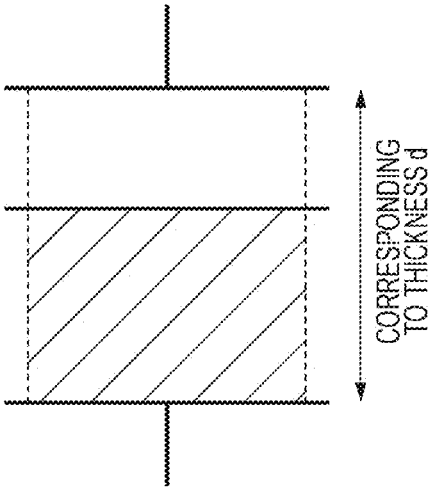
FIG. 17B is a schematic view for illustrating a difference in charging process of charge.
Figure 17C:
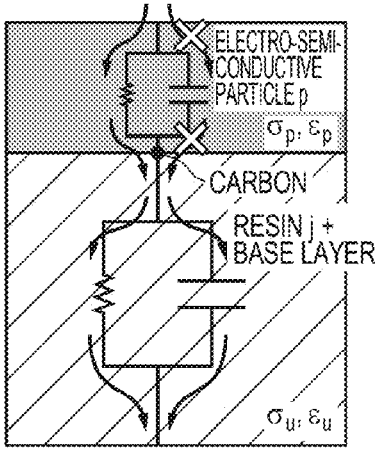
FIG. 17C is a schematic view for illustrating a difference in charging process of charge.
Figure 17D:
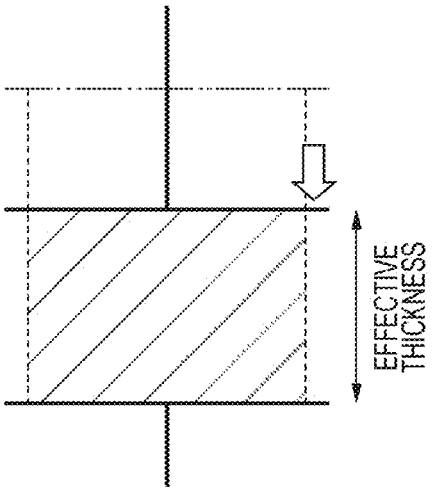
FIG. 17D is a schematic view for illustrating a difference in charging process of charge.

When the components are synthesized into the electro-semiconductive particle p component and the component u except the component out of the plurality of circuits like the section (b) of FIG. 16, a state where the value of the left side of the formula (10) is small means that the electro-semiconductive particle p component and the component u except the component are close to each other in balance between conduction and induction. In addition, in contrast, a state where the value is large means that layers different from each other in balance between conduction and induction are laminated. When the layers different from each other in balance between conduction and induction are laminated, the speed at which charge is accumulated varies from dielectric layer to dielectric layer, and hence frequency dependence occurs. Specifically, in the case of a high-frequency band, the dielectric components of the respective layers are each in a chargeable state (FIG. 17A) because charge flows in before the completion of the charging of the dielectric component of each layer with charge. At this time, the entirety of the developing roller can be attributed to a model in which dielectric materials are laminated, and an amount corresponding to a thickness d of the respective laminated layers is reflected in the capacitance of the entirety of the developing roller (FIG. 17B). On the other hand, in the low-frequency band, the roller has a sufficient charging time, and hence a layer whose charging is completed and a layer whose charging is not completed are liable to occur. In the layer whose charging has been completed, the behavior of only a resistance component becomes dominant and the layer is hardly reflected in the capacitance of the entirety of the developing roller. Accordingly, only the dielectric component of the layer whose charging is not completed may be reflected in the capacitance component of the entirety of the developing roller (FIG. 17C). In other words, only an amount corresponding to the thickness of the uncharged layer smaller than the thickness d of the layers to be originally laminated affects the capacitance component of the entirety of the developing roller (FIG. 17D). The thickness d of the laminate of the respective layers corresponds to the distance d between parallel plate electrodes, and the capacitance C is inversely proportional to the distance d between the electrodes. The thickness corresponding to the uncharged layer is smaller than the thickness of all layers to be laminated, and hence the capacitance of the entirety of the developing roller increases. As described above, in the case where the layers different from each other in balance between conduction and induction are laminated, when a frequency band changes, the speed at which charge is accumulated varies from dielectric layer to dielectric layer, and the thickness of the dielectric layer involved in the entirety of the developing roller changes, whereby the frequency dependence of the capacitance component of the entirety of the developing roller occurs. On the other hand, in the case where the layers close to each other in balance between conduction and induction are laminated, even when the frequency band changes, the dielectric component of each layer is reflected in the capacitance component of the entirety of the developing roller, and hence its dependence on a frequency can be reduced. Further, when the thickness of the entirety of the developing roller does not change like this example, an excess increase in capacitance component of the entirety of the developing roller in the low-frequency band can be suppressed. That is, the foregoing means that as the value of the left side of the formula (10) reduces, an increase in capacitance can be suppressed to a larger extent in the low-frequency band.

Figure 11:
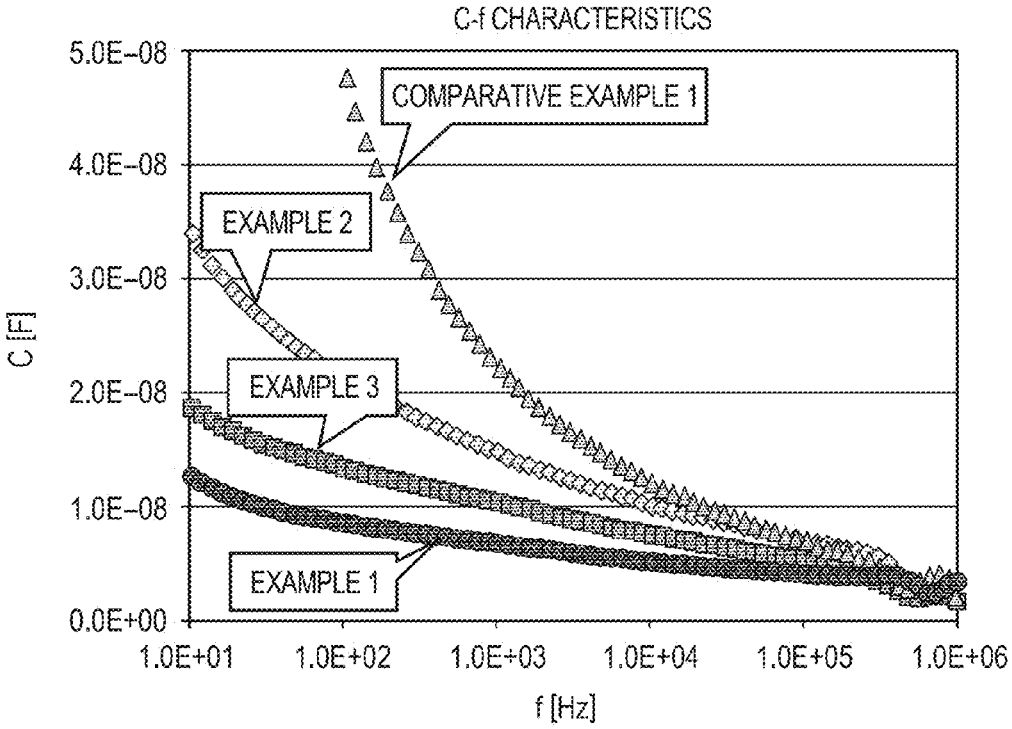
FIG. 11 is a graph of the frequency characteristics of capacitances in Examples 1 to 3 and Comparative Example 1.

The values of the left side of the formula (10) of Examples 1 to 7 of the present invention are described. In Examples 1, 4, 6, and 7, the values are as small as 0.5, 0.9, 0.7, and 0.2, respectively, which means that an increase in capacitance component of the entirety of the developing roller with a change in frequency is small. As a result, the fogging amount can be stably suppressed even in the low-speed mode of Embodiment 2 in which charge is liable to attenuate toward the developing roller. On the other hand, in Example 2 or Example 3, the value is somewhat large and hence a slight increase in fogging amount occurs. A possible reason for the foregoing is that the capacitance of the entirety of the developing roller slightly increases in the low-frequency band. In addition, Example 2 is different from Example 1 in that the kind of the electro-semiconductive particle p is changed, and Example 4 is different from Example 1 in that the kind of the resin j is changed. The values of the left side of the formula (10) of both the examples are larger than the value of Example 1, but the value of the left side of the formula (10) of Example 2 is 1.6, which is a value even larger that of Example 4, and hence an increase in fogging in the low-speed mode occurs. In addition, in Example 3 as well, the value of the left side of the formula (10) is large and hence a slight increase in fogging occurs, but no slight increase in halftone image failure at the normal speed is observed. In addition, as illustrated in FIG. 11, the frequency dependence of the capacitance of the developing roller is found to reduce in association with the value of the left side of the formula (10). It should be noted that the notation "E+n" means "$\times 10^{n}$" and the notation "E−n" means "$\times 10^{-n}$".

In Example 4, the value of the left side of the formula (10) is 0.9, which is a relatively low value, and hence neither an increase in fogging in the low-speed mode nor a halftone image failure is observed. It is because of the following reason that the value of the left side of the formula (10) slightly increases as compared with that of Example 1: in Example 4, the NCO/OH group ratio of the urethane resin is smaller than that of Example 1, and hence the electroconductivity $\sigma_j$ of the resin is large, and a difference in balance between conduction and induction between the layers constituting the developing roller enlarges.

Example 5 is different from Example 1 in that the kind of the ZnO particle as the electro-semiconductive particle p is changed. A main factor of an increase in value of the left side of the formula (10) is that the electroconductivity $\sigma_p$ of the ZnO particle (B) is smaller than that of the ZnO particle (A) used in Example 1 and hence the value of the ratio ($\sigma_p/\in_p$) deviates from that of the ratio ($\sigma_u/\in_u$). A factor of the fact that even similar ZnO particles differ from each other in electroconductivity like the ZnO particle (A) and the ZnO particle (B) is considered as described below. A ZnO particle has a hexagonal crystal structure, and in most of the ZnO particles commercially available in powder shapes, defective portions of the crystal structure such as the missing of an O particle are present. The electroconductivity of a particle tends to reduce as the number of such defective portions reduces and hence its crystallinity becomes higher. The ZnO particle used in Example 5 may have a lower electroconductivity because its crystallinity is higher than that of the particle used in Example 1.

Figure 18:
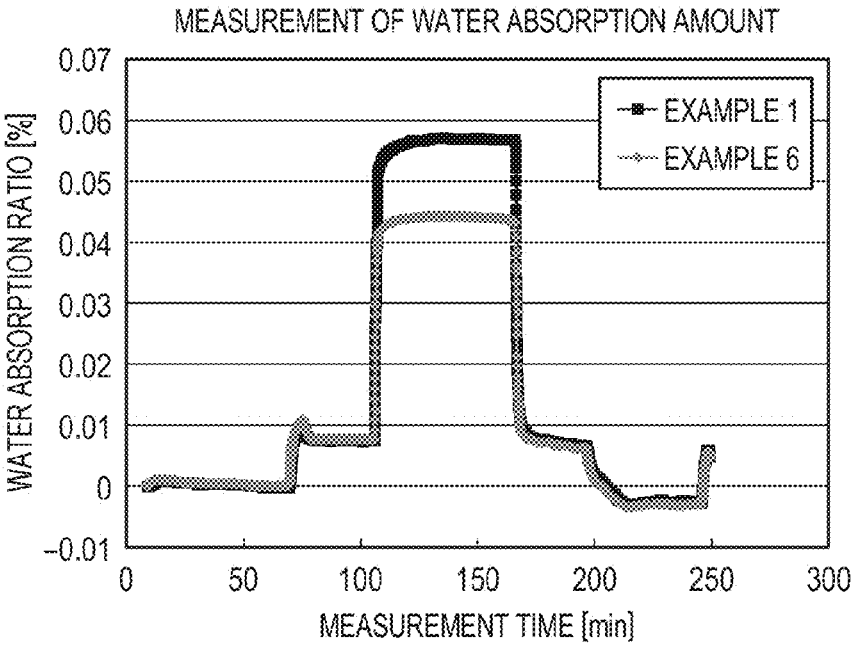
FIG. 18 is a graph for showing the results of the measurement of water absorption amounts in Examples 1 and 6.

Example 6 is different from Example 1 in that the "polyurethane C" is used as a raw material for the resin j. A main factor of an increase in value of the left side of the formula (10) is that the electroconductivity $\sigma_j$ of the polyurethane C is smaller than that of the polyurethane A used in Example 1 and hence the value of the ratio ($\sigma_u/\in_u$) deviates from that of the ratio ($\sigma_p/\in_p$). A factor of the fact that the electroconductivity of the polyurethane C is lower than that of the polyurethane A is considered as described below. The results of the measurement of the water absorption amounts of the developing roller of Example 1 (using the polyurethane A) and the developing roller of Example 6 (using the polyurethane C) are shown in FIG. 18. It is found from FIG. 18 that the water absorption ratio of the developing roller of Example 6 is smaller than that of Example 1. That is, it is found that the hydrophobicity of the polyurethane C is higher than that of the polyurethane A. It is assumed from the foregoing that the polyurethane C suppresses the water absorption of the resin in the high-temperature and high-humidity environment (having a temperature of 30° C. and a relative humidity of 80%) where this evaluation has been performed, and hence suppresses increases in electroconductivity and dielectric constant due to water. Accordingly, the resin may have the following characteristics even under the environment: a low electroconductivity and a low dielectric constant. A method of measuring a water absorption amount is described below.

[Measurement of Water Absorption Amount]

Figure 19:
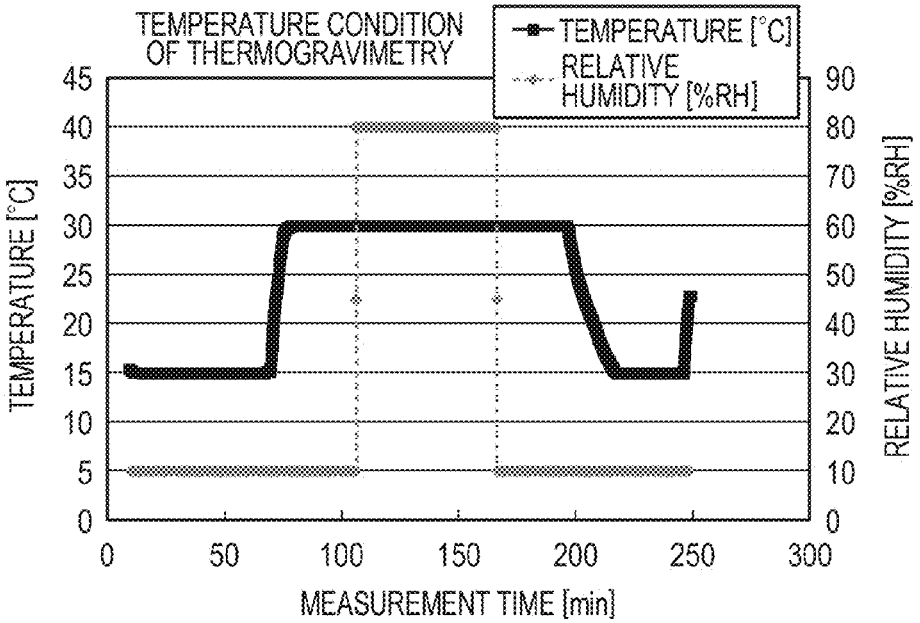
FIG. 19 is a graph for showing temperature and humidity conditions in the measurement of a water absorption amount.
Figure 20A:
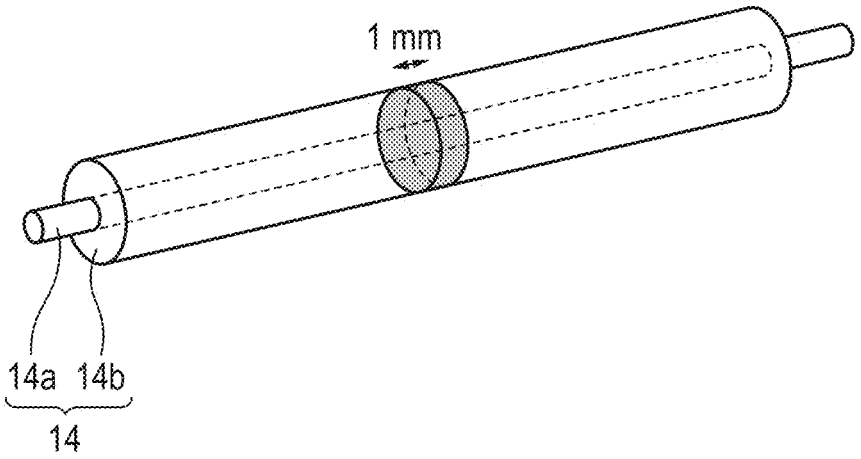
FIG. 20A is a view for illustrating a method of producing a sample piece of the developing roller used in the measurement of a water absorption amount.
Figure 20B:
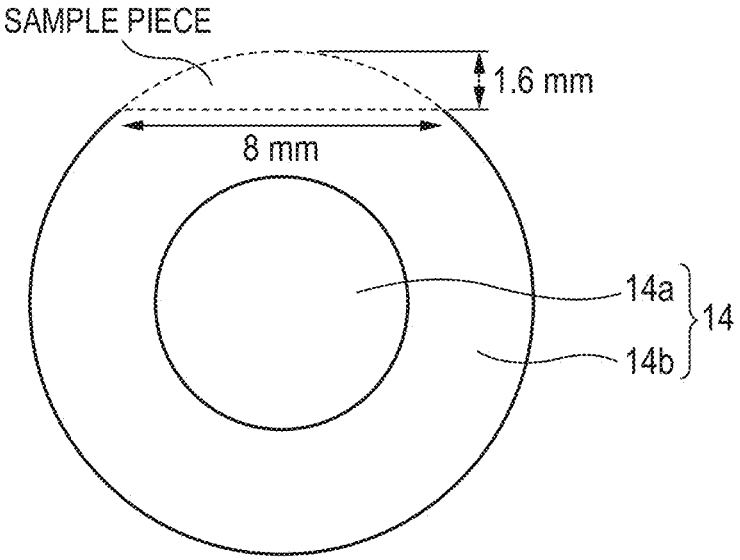
FIG. 20B is a view for illustrating the method of producing the sample piece of the developing roller used in the measurement of a water absorption amount.

The measurement of a water absorption amount was performed with a calorimeter (trade name: Model Q5000, manufactured by TA Instruments). A developing roller was cut in its longitudinal direction so as to have a width of 1 mm (see FIG. 20A). After that, a section was cut out of the cut surface so as to measure 8 mm in the widthwise direction of the roller and 1.6 mm from its surface in its thickness direction, and was defined as a sample piece to be used in the measurement of the water absorption amount (see FIG. 20B). Measurement conditions are shown in FIG. 19. As an indicator for evaluating a water-absorbing property from a temperature of 15° C. and a relative humidity of 10% to a temperature of 30° C. and a relative humidity of 80%, a water absorption ratio was defined as described below by using a mass M0 of the sample at a temperature of 15° C. and a relative humidity of 10%, and a mass M1 of the sample at a temperature of 30° C. and a relative humidity of 80%.

$$\text{Water absorption ratio [\%]}=(M1-M0)/M0\times 100$$

The inventors of the present invention have made extensive investigations, and as a result, have confirmed that when a urethane resin whose water absorption ratio measured by the method is 0.045% or less is used, the resin shows the following characteristics in a high-temperature and high-humidity environment (having a temperature of 30° C. and a relative humidity of 80%): a low electroconductivity and a low dielectric constant.

Example 7 is different from Example 1 in that the kind of the ZnO particle as the electro-semiconductive particle p and the kind of the polyurethane as the resin j are changed. The result of the evaluation for endurance fogging in Embodiment 1 is significantly satisfactory because the value of the left side of the formula (10) is 0.2, which is an extremely low value. Examples 5, 6, and 7 are developing rollers in which the combination of the electro-semiconductive particle p and the resin j is changed, and the value of the left side of the formula (10) is lowest in Example 7. A factor of the foregoing is that the values of the electroconductivities and dielectric constants of the electro-semiconductive particle p and the resin j used in Example 7 were a preferred combination for bringing the respective layers constituting the developing roller close to each other in balance between conduction and induction. Specifically, in Example 7, the value of the ratio $\sigma_p/\in_p$ was $2.5\times 10^{-11}$ and the value of the ratio $\sigma_u/\in_u$ was $3.9\times 10^{-11}$, which were values extremely close to each other, and hence the value of the left side of the formula (10) became 0.2, which was a low value.

As can be seen from the foregoing, in the present invention, it is preferred that a low-capacitance material involved in an electro-conductive path be selected, and a developing roller be formed of materials close to each other in balance between a dielectric component and an electro-conductive component in accordance with the respective materials. Specifically, the relationship represented by the formula (10) is preferably satisfied. In addition, in order that frequency characteristics may be improved, the value of the left side of the formula (10) is more preferably 1.0 or less.

Further, in Example 8, a satisfactory image can be obtained. In Example 8, the zinc oxide particle is exposed to the surface of the developing roller and hence charge-providing performance for a toner improves. As a result, in addition to the suppressing effect of the present invention on the attenuation of the charge of the toner, a charge-providing effect on the toner is obtained and hence the suppression of the fogging amount can be effectively performed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-134823, filed Jun. 30, 2014, which is hereby incorporated by reference herein in its entirety.

What is claimed is:

1. A developer carrying member, comprising:

an electro-conductive mandrel; and an electro-conductive elastic layer, wherein:

the elastic layer contains a resin j, an electro-semiconductive particle p, and an electro-conductive particle c; and when an electroconductivity of the resin j is defined as $\sigma_j$, a dielectric constant of the resin j is defined as $\in_j$, an electroconductivity of the electro-semiconductive particle p is defined as $\sigma_p$, and a dielectric constant of the electro-semiconductive particle p is defined as $\in_p$, $\sigma_j$, $\in_j$, $\sigma_p$, and $\in_p$ satisfy relationships represented by the following formulae (1) and (2), $\sigma_j$, $\in_j$, $\sigma_p$ and $\in_p$ being calculated by an AC impedance method $$\sigma_j<\sigma_p<0.05\ \text{S/cm} \quad (1)$$

$$\in_p<\in_j \quad (2).$$

2. A developer carrying member according to claim 1, wherein in the electro-conductive elastic layer, when an electroconductivity of the electro-semiconductive particle p component is defined as $\sigma_p$, a dielectric constant of the electro-semiconductive particle p component is defined as $\in_p$, an electroconductivity of a component u except the electro-semiconductive particle p is defined as $\sigma_u$, and a dielectric constant of a component u except the electro-semiconductive particle p is defined as $\in_u$, $\sigma_p$, $\in_p$, $\sigma_u$, and $\in_u$ have a relationship represented by the following formula (10), $$|\log_{10}[(\sigma_p/\in_p)/(\sigma_u/\in_u)]|<1.5 \quad (10)$$

Wherein $\sigma_p$, $\in_p$, $\sigma_u$, and $\in_u$ being calculated through separation of constituent components of the layer into the electro-semiconductive particle p component and the component u except the electro-semiconductive particle p by the AC impedance method.

3. A developer carrying member according to claim 1, wherein the resin j, the electro-semiconductive particle p, and the electro-conductive particle c incorporated into the electro-conductive elastic layer are a urethane resin, a zinc oxide particle, and a carbon particle, respectively.

4. A developer carrying member according to claim 3, wherein a volume occupancy of the zinc oxide particle in the electro-conductive elastic layer increases toward a vicinity of a surface of the electro-conductive elastic layer.

5. An image forming apparatus, comprising:

an image-bearing member configured to bear an electrostatic latent image; and a developer carrying member configured to carry a developer and to contact with the image-bearing member to develop the electrostatic latent image with the developer, wherein:

the developer carrying member comprise:

an electro-conductive mandrel; and an electro-conductive elastic layer, wherein:

the elastic layer contains a resin j, an electro-semiconductive particle p, and an electro-conductive particle c; and when an electroconductivity of the resin j is defined as $\sigma_j$, a dielectric constant of the resin j is defined as $\in_j$, an electroconductivity of the electro-semiconductive particle p is defined as $\sigma_p$, and a dielectric constant of the electro-semiconductive particle p is defined as $\in_p$, $\sigma_j$, $\in_j$, $\sigma_p$, and $\in_p$ satisfy relationships represented by the following formulae (1) and (2), $\sigma_j$, $\in_j$, $\sigma_p$ and $\in_p$ being calculated by an AC impedance method $$\sigma_j<\sigma_p<0.05\ \text{S/cm} \quad (1)$$

$$\in_p<\in_j \quad (2).$$

* * * * *